US006021865A

United States Patent [19]

Thompson et al.

[11] Patent Number: 6,021,865

[45] Date of Patent: Feb. 8, 2000

[54] LOAD-DISPERSING DEVICE FOR PORTABLE NON-FREE-STANDING LADDERS

[76] Inventors: John G. Thompson, 316 E. Main St., Orange, Va. 22960; Wilfred L. Harris, Jr., 12129 Hidden Lakes, Culpeper, Va. 22701-3728

[21] Appl. No.: 08/910,497

[22] Filed: Aug. 4, 1997

Related U.S. Application Data

[63] Continuation-in-part of application No. 08/448,186, May 23, 1995, abandoned.

[51] Int. Cl.[7] ..... E04G 5/02

[52] U.S. Cl. ..... 182/107; 182/214

[58] Field of Search ..... 182/107, 108, 182/129, 206, 214

[56] References Cited

U.S. PATENT DOCUMENTS

| | | | |
|---|---|---|---|
| 533,392 | 1/1895 | Lord | 182/214 |
| 1,600,103 | 9/1926 | Evans | 182/108 |
| 2,138,171 | 11/1938 | Johnson | 182/111 |
| 2,803,388 | 8/1957 | Ross | 182/214 X |
| 2,904,128 | 9/1959 | Boham et al. | 182/108 |
| 3,662,856 | 5/1972 | D'Amico et al. | 182/108 |
| 3,910,380 | 10/1975 | Nameche | 182/206 |
| 3,948,353 | 4/1976 | Lane | 182/206 |
| 3,993,163 | 11/1976 | Barrett | 182/108 |
| 4,444,291 | 4/1984 | McPherson | 182/107 X |
| 4,469,194 | 9/1984 | McBride | 182/107 |
| 4,580,660 | 4/1986 | Oling | 182/107 |
| 4,580,661 | 4/1986 | Thomson, Jr. | 182/107 |
| 4,601,365 | 7/1986 | Davis | 182/230 |
| 4,726,446 | 2/1988 | Perbix | 182/46 |
| 4,754,842 | 7/1988 | Southern | 182/111 |
| 4,771,862 | 9/1988 | Garland | 182/108 |
| 4,899,848 | 2/1990 | Parr | 182/108 |
| 4,924,971 | 5/1990 | Rice | 182/93 |
| 4,974,699 | 12/1990 | Boring | 182/107 |
| 5,121,813 | 6/1992 | Funston | 182/203 |
| 5,165,641 | 11/1992 | Southern | 182/214 X |
| 5,293,958 | 3/1994 | Swiderski | 182/214 |
| 5,533,591 | 7/1996 | Kiska | 182/108 |

*Primary Examiner*—Daniel P. Stodola
*Assistant Examiner*—Richard M. Smith
*Attorney, Agent, or Firm*—Sheldon H. Parker

[57] ABSTRACT

A load-dispersing device for use with a ladder has a pail of flexible members having first and second configurations and a memory to return the members from the second to the first configuration. An interior cavity within each member is exposed, when each member is in the second configuration, through a longitudinal slit. Separating the longitudinal slit exposes the interior cavity placing the member in the second configuration for mounting on the respective ladder side rail and releasing the longitudinal slit returns the member to the first configuration and secures the member around the respective side rail. The member having contact and locking areas which can be manufactured either from separate material or integral with one another. The contact area can have an undulating surface and can have a spring embedded within the contact area to return the member to the first configuration. The contact area can alternatively be adhered directly to the load-bearing surface of the ladder.

15 Claims, 20 Drawing Sheets

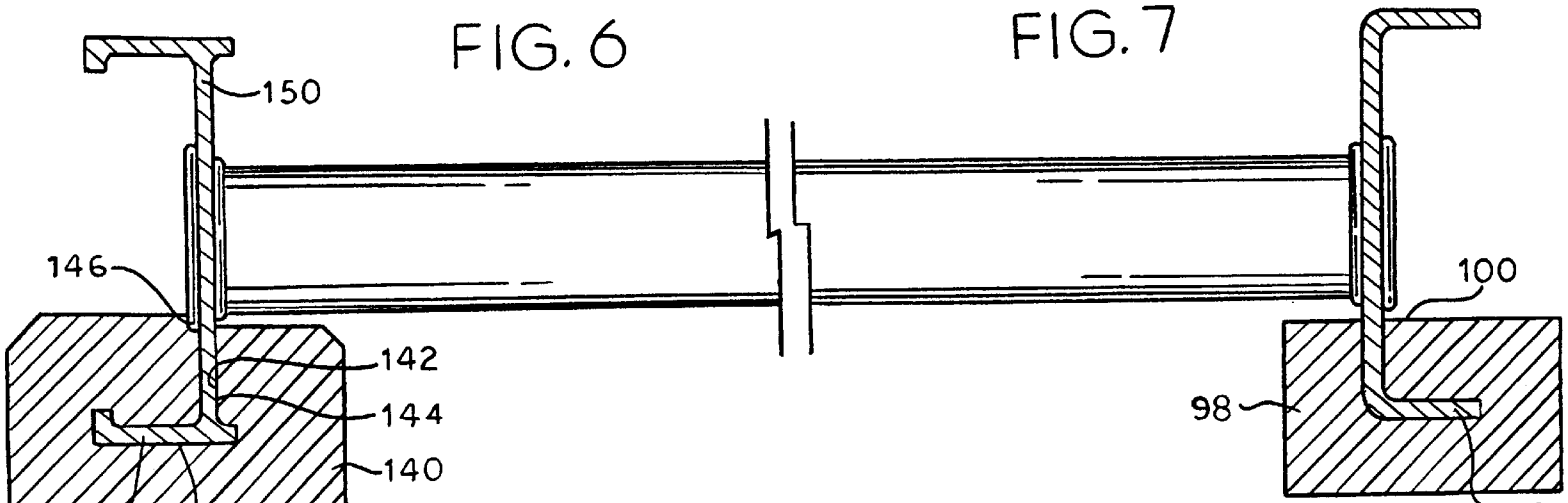
FIG. 7
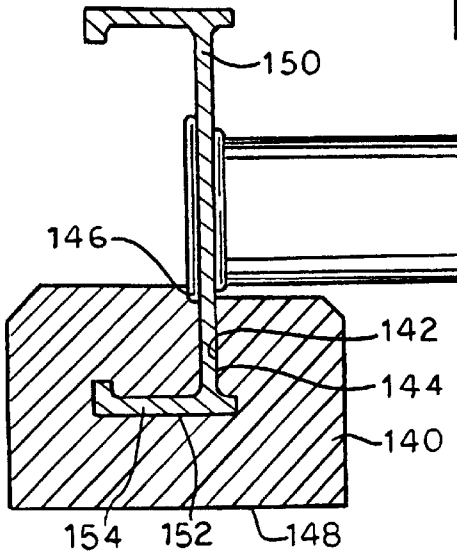
FIG. 6
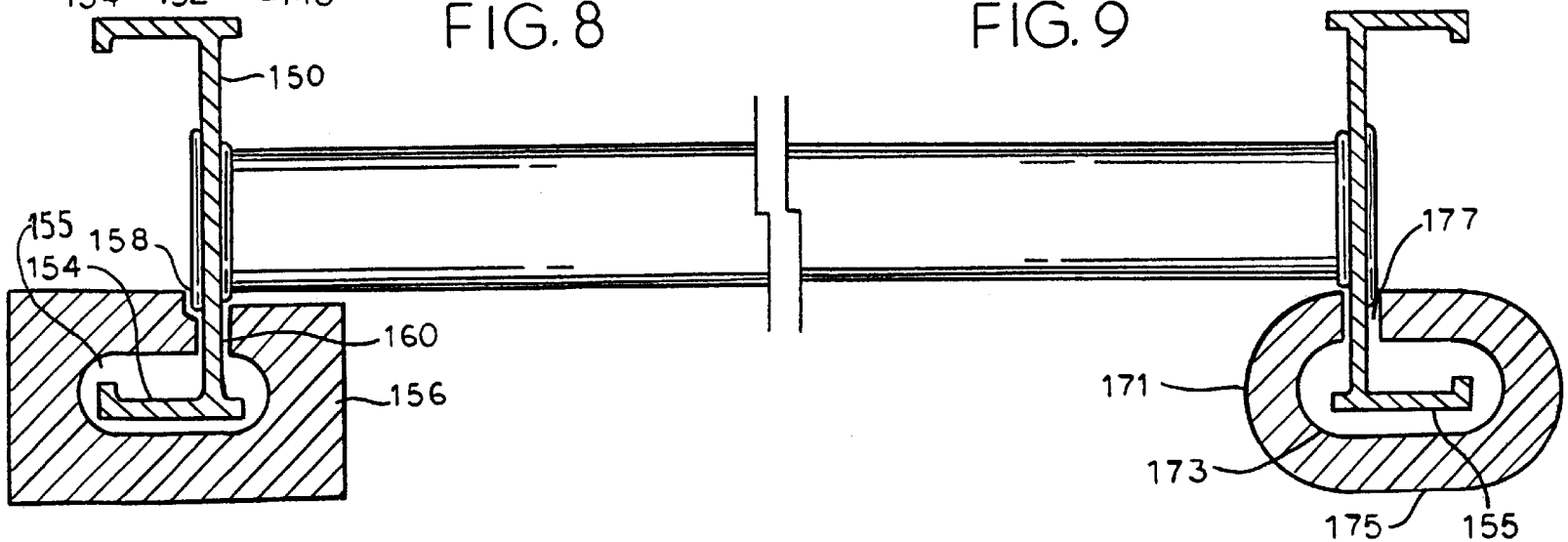
FIG. 9
FIG. 8

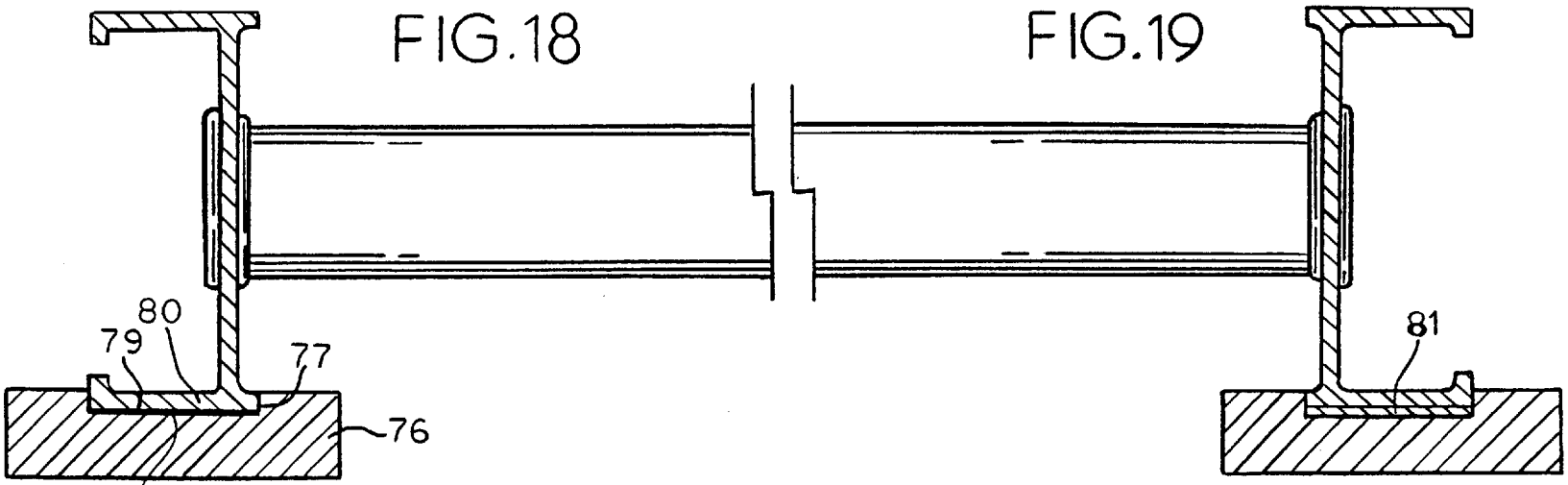
FIG.19
FIG.18
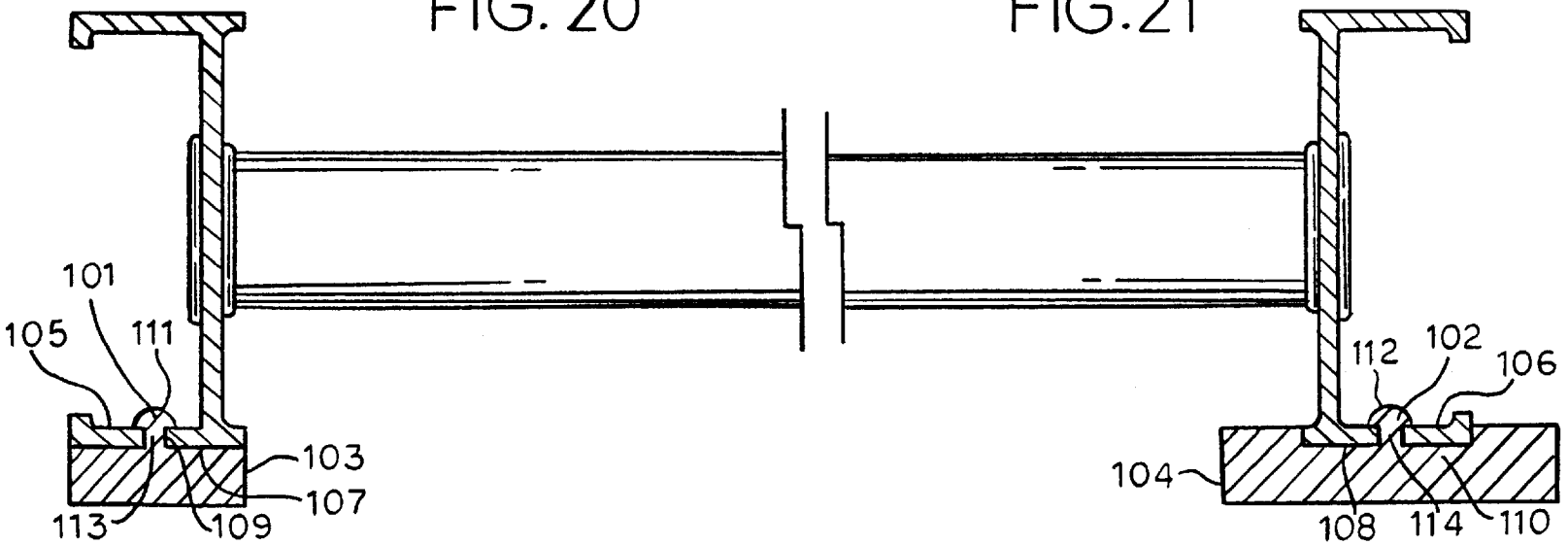
FIG.21
FIG. 20

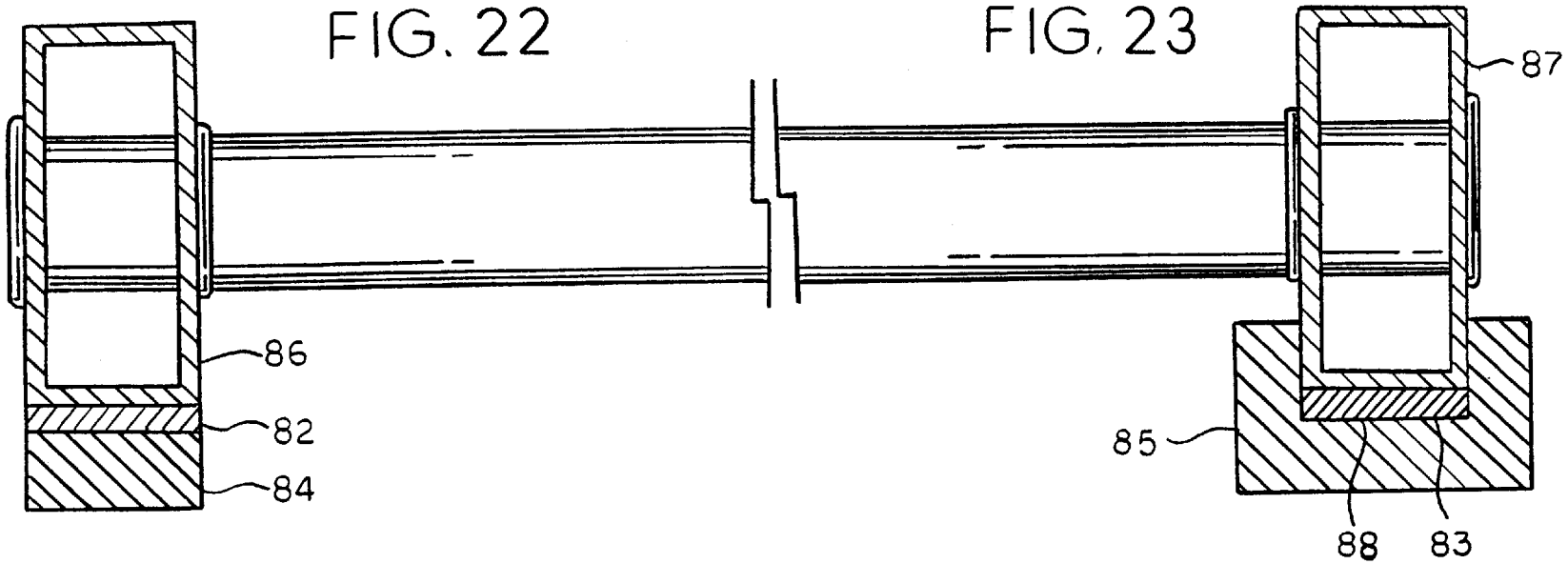
FIG. 23
FIG. 22
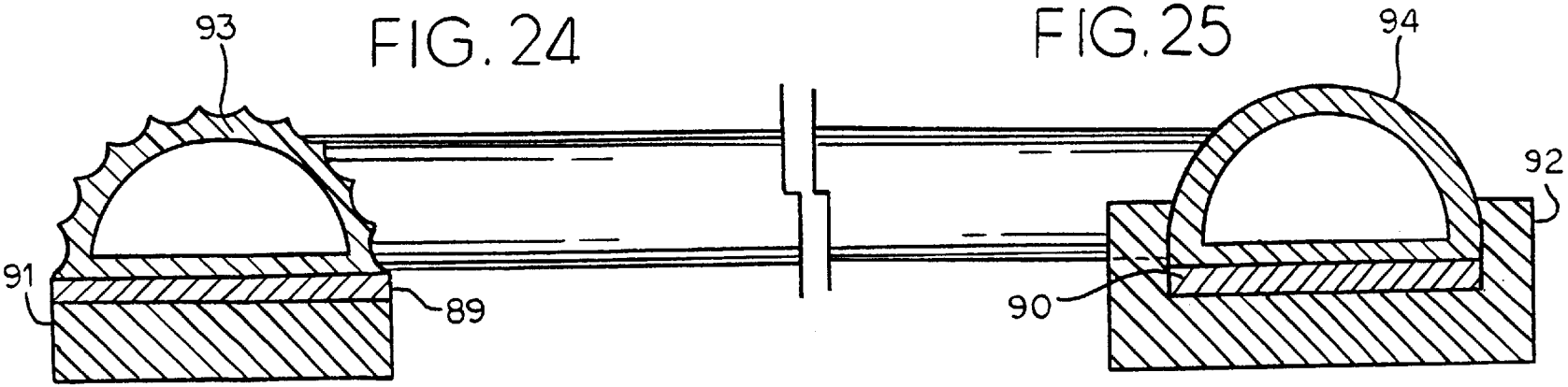
FIG. 25
FIG. 24

FIG. 29-A

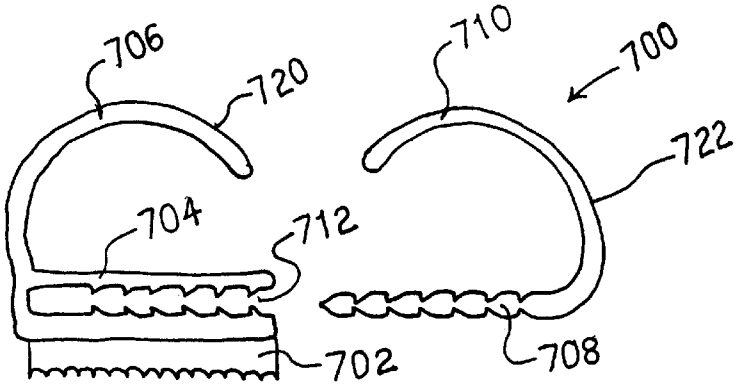
FIG. 34
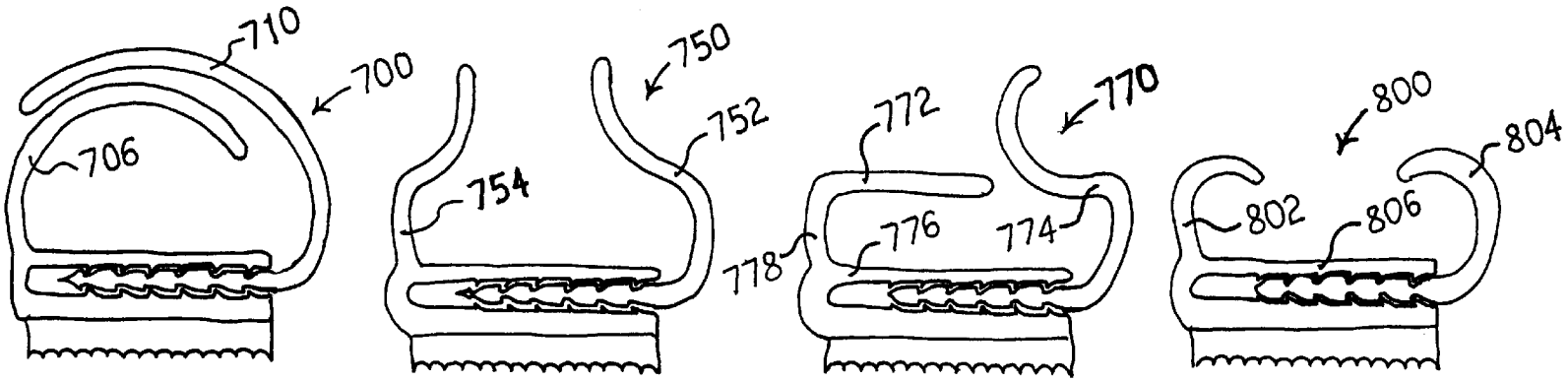
FIG. 37-A
FIG. 37
FIG. 36
FIG. 35

LOAD-DISPERSING DEVICE FOR PORTABLE NON-FREE-STANDING LADDERS

This is a continuation-in-part of application(s) Ser. No. 08/448,186 filed on May. 23, 1995, now abandoned.

BACKGROUND OF THE INVENTION

1. Field of the Invention

The present invention generally relates to a protective, load dispersing device which prevents the slippage of a ladder as well as preventing damage to the surface against which the ladder rests. An in alternate embodiment, the protective bumpers can be used to protect one or more sides of a three dimensional object.

2. Description of the Background of the Invention

There are two common problems arising from the use of ladders in work on buildings, particularly on or near their roofs, that are minimized by the novel device according to this invention.

First, the thrust component of the combined weight of the ladder, the user, and any equipment the user may be carrying is commonly born by two small areas of contact between the side members of the ladder and the structure receiving the ladder. The tendency of that thrust component on the gutter is to dent it, and in the worst case to deform the strengthening formed edge of the gutter so that it collapses. As the gutter flexes it can readily be seen that the areas of contact between it and the side members of the ladder decrease from that of the flat contact between the underside of the ladder's side members and the gutter edge, until the gutter edge supports only the corners of the undersides of the ladder side members. It is then that the maximum deformation of the gutter profile and the greatest damage to its paint occur. Added to the causes of paint damage are the sliding which occurs between the gutter's paint coating and the side members of the ladder, as the ladder flexes while the user is moving on it.

Second, ladders have the tendency to slip sideways when there are small movements by their feet, typically caused by the feet being placed in error by the user on soft ground or on unstable propping material. Since the width of a ladder is small compared with its height, when the weight of a user of the ladder is near its top, the rate of sideways slippage accelerates the farther the line of the feet diverges from the horizontal. As will be seen, this problem has in previous inventions been dealt with by fixing in some way the upper part of the ladder to the building, its roof or its gutter. That purported solution is unsatisfactory, however, because fixing the top may require the ladder's feet to be in a location which may not be stable, and the user is then dependent for his security on the upper fixing means, obviously not as reliable as a stable location for the feet. The device according to the present invention overcomes that defect of the earlier inventions by allowing the upper part of the ladder freedom of positioning both along and transverse to the gutter or other building feature upon which the upper part of the ladder is to rest, thereby permitting the feet of the ladder to be located on the necessary firm and level support.

All these tendencies to damage are eliminated by use of the device according to this invention, which places a flexible, non-slip, non-abrasive, non-electrically-conductive bearing surface between the ladder's side members and the gutter or other feature of the structure against which the ladder rests.

This invention also has the important advantage that it may be manufactured in materials that enable it to provide electrical insulation from the upper support surface for the ladder on which it is mounted.

Several other patents have been granted for inventions intended to prevent ladders from slipping along their upper support surfaces, but none so far has offered a solution to the foregoing problems of damage to the upper support surface and slipping. For example, U.S. Pat. No. 3,948,353, issued to Lane, teaches an non-free-standing ladder with flanged and lined cut-out portions along the side members of its upper section, said cut-out portions being intended to hook over the upper support, with the lining providing an anti-skid surface. It can be readily seen that manufacturing the ladder claimed in Lane with its flanged cut-out portions would be more expensive than for the standard metal or Fiberglas ladder commonly available, and to which this invention is adapted, of which the side members are extruded or molded with the same cross section along their entire lengths. Furthermore, since the ladder in Lane is intended to be hooked over a fixed upper support, such as a gutter, the ladder user has a restricted opportunity of adjusting the foot of the ladder to find a stable lower support, which is a safety measure of even greater importance than any such measures taken at the upper end of the ladder, since, without a stable lower support, the ladder should not be used. Also, when the ladder is being used, that is, when weight is applied to it, any flexing of the ladder, which always occurs, and any effort of the lower end of the ladder to find a stable footing, will tend to drag down the upper support over which the ladder is hooked. This might seriously damage, for example, a lightweight aluminum gutter used as the upper support.

U.S. Pat. No. 5,121,813, issued to Funston, teaches a rigid leg member to provide stable support for the lower end of a ladder, combined with a hooking support for hooking to, for example, a gutter. A separate lower support as in Funston is not part of the present invention, which relies on the user establishing a stable footing for his ladder, and assists the user in doing this by allowing the upper support of the ladder to be adjusted up or down the length of this invention, without hooks or fixing means at the upper support. The tendency to drag the exemplary gutter down by hooked elements is the same in Funston as in Lane, that is when the ladder flexes in use. Also, the metal hook elements in Funston would tend to scratch the painted surface of the upper support.

U.S. Pat. Nos 4,924971, issued to Rice, 4,601,365, issued to Davis, and 4,580,661, issued to Thomson, Jr., all teach inventions that require for their operation installation on or in the upper support, which in the cases of Davis and Thomson, Jr. appear to be restricted to gutters. Obviously, such installation negates the purpose of the respective invention to a certain extent, since the ladder must be used initially to install the Rice, Davis and Thompson,Jr., inventions, and until such installation is done the respective inventions are ineffective. This contrasts with the benefits of the present invention, where the safety device to which the invention is directed is installed on the ladder before use and requires no fixing to the upper or lower ladder support surface. The present invention also enables a non-free-standing ladder on which it is used to be lengthened or shortened, and moved along the building, or other structure on which work is proceeding, without adjustment of the device. In the case of Rice, the invention must be reinstalled at the upper support for each new location in order for the ladder to be moved; in the cases of Davis and Thompson, Jr., the inventions must be moved when the ladder is moved, or additional devices according to the respective inventions must be installed at the new locations.

U.S. Pat. Nos. 5,293,958, issued to Swiderski et al., and 4,754,842, issued to Southern both teach devices for propping the tops of ladders away from walls. This feature enables a ladder user to work up to the level of the top of a wall or possibly slightly above, but does permit the user to step off the ladder on to the roof of a structure, to do which would require according to standard practical that the ladder extend over the lower edge of the roof by between one and three feet. By contrast, the present invention, of which one of the advantages is that it promotes the safety of stepping from a ladder to a roof allows the ladder to rest against lower edge of the roof, against a gutter, for example, while reducing the possibility of the ladder's slipping sideways, according to the standard recommendations.

U.S. Pat. Nos. 4,974,699, issued to Boring, 4,726,446, issued to Perbix, and 4,469,194, issued to McBride, all teach attachments to the upper end of a ladder, intended for resting, not against a roof edge, gutter or the like as in the case of the present invention, but against a Vertical wall. They are therefore not adapted to the purpose of allowing the user to step from the ladder on to the roof of the walled structure. The devices taught by Boring, Perbix and McBride would be difficult to align with a roof edge or gutter from a position at the bottom of the ladder, because of their short length. That of Boring, being of circular cross section, and that of McBride, being of narrow rectangular section would be prone to slip off a roof edge or gutter during use, probably causing damage thereto., That according to Perbix, while being short enough to cause difficulty in aligning it with the roof edge or gutter, would prevent the ladder side members of an extension ladder from sliding within one another when the ladder is shortened, in contrast to the present invention.

SUMMARY OF THE INVENTION

The present invention is directed to a load-dispersing device for any portable non-free-standing ladder, reducing damage of delicate surfaces on which the upper portion of the ladder is supported.

The invention comprises a pair of lengths of soft, flexible material in the preferred embodiment of the invention about 3 to 5 feet long, each enclosing an internal cavity formed to accommodate the side member of a ladder. In use, the device is fitted to the side members of a ladder, covering the faces of the side members that would otherwise make contact with the supporting structure. The soft flexible material has an exterior surface of a high coefficient of friction. In alternate embodiments a layer of a material having a higher durability or coefficient of friction on its surface can be added. The load dispersing device acts to disperse the load of the ladder to prevent damage to fragile surfaces, absorb small transverse movements due to flexing, and increase the friction, with the result that; the ladder is less prone to slip sideways during use.

Although the device according to this invention cannot select a suitable footing, it makes the work of locating such a footing more convenient for the user, and hence the user may be likely in many cases to take the necessary extra care. In contrast to many other devices, including some cited herein as the subjects of U.S. patents for safety devices, the device according to this invention enables the ladder to be used for gaining access to the upper surface, for example the roof of the structure on which the ladder is placed. As can be readily seen, a ladder, if long enough, fitted with the device can be so placed that the top one, two or three rungs, according to choice, project above the upper ladder support, and thus provide the necessary support for a user stepping off the upper end of the ladder, as in standard practice.

Since the ladder must be without load while it is being adjusted, the friction of the contact surface of the device will not prevent the ladder from being slid into position, but the softness of contact surface will avoid scratching during such adjustment. Scratching is also caused by flexing of the ladder during use, which slides the side members of the ladder transversely across its upper support because the lower support of a non-free-standing ladder in use should remain motionless. The soft flexible material of the contact surface of the device accommodates without slipping the small movements of the ladder caused by such flexing.

In the case of a fragile structural element as the upper support for a non-free-standing ladder, damage often occurs because the thrust component of the combined weight of the ladder, its user, and its user's equipment, in the absence of the device according to this invention, impinges on a small area of the element, creating a high localized pressure. In the typical case of a standard thin-walled aluminum gutter, which relies on its profile for such rigidity as it has, the pressure becomes greater as deformation from the ladder thrust component increases, because the gutter surface then bends out of uniform contact across the flat surfaces of the ladder side members, thus reducing the surface area on which the thrust is applied to just the corners of the ladder's side members. The resulting pressure can stress the aluminum beyond its elastic limit, so that the gutter collapses. However, it can readily be seen that the use of the device according to this invention, with its upper support contact area softer than those of the laddern side members to which it is fitted, spreads the thrust, cushions the impact of the placing of the ladder into the desired position, and accommodates the flexing movement. Thus this invention prevents damage from scratching, and from collapse or other types of breakage.

Various versions of the preferred embodiment of the load-dispersing device are within the scope of this invention. For example, the lengths of soft, flexible material may be made in several cross-sectional shapes, such as for example, with planar support contact surfaces, with convex-curved support contact surfaces which flatten against the support surface when the ladder to which the device is fitted is rested against its intended upper support, with concave support contact surfaces which flatten under load so as better to distribute the load with or without resilient stiffening strips arranged parallel to the respective contact surfaces within the soft flexible material of the device, with contact faces made of material of different density or a higher coefficients of friction than that of the soft flexible material backing the contact face, with contact faces patterned so as to improve the non-slip qualities of the device, with cavities of various shapes to accommodate various profiles or no particular cross-sectional profile of ladder side member, and with or without internal adhesive or hook-and-loop fasteners to fix the device in position on a ladder. Embodiments of the device may also be made wherein the device is affixed, by adhesive or, for example, hook-and-loop fasteners, to the exterior part of the ladder support flange, with or without enclosing the edges or rear of the flange. In addition the device may be provided with end caps arranged to cover the upper ends of the respective ladder upper side member. In addition the device may be arranged with cut-out portions along the respective lengths to accommodate the ladder rungs. These and other meritorious features of the present invention will be more fully appreciated from the following description and claims.

A two piece, locking protection device is disclosed which has at least one U-shaped female clip member and at least one male clip member. The female clip member has a first leg, a second leg, a connecting member, an open receiving slot and a length. The receiving slot extends the length of the female clip member. The female clip has a first affixing device which is proximate the first leg. A ridged receiving are is within at least a portion female clip member. The male clip member has a second affixing device proximate one end and a ridged locking area which is dimensioned to be received within and interlock with the ridged receiving means. The device further consists of at least one protective bumper.

The first affixing device on the female clip member extends at less than a 90 degree angle from the first leg. The male clip member further comprises a connection member which connects a first portion of the second affixing means in a position parallel to the male clip member. A second portion, adjacent the connection member, extends at less than a 90 degree angle from the male clip member. The male clip member can also include spring means proximate the second portion and positioned to maintain the protection device in position on said ladder. Alternatively, the spring means can be placed the first and second portion and positioned to maintain said protection device in position on the ladder. The bumper means can have an uneven surface to provide improved slip resistance. The bumper means can be proximate the second leg.

In another embodiment the first and second U-shaped members are integral with each end of the first affixing means and a first and a second male clip member are integral with each end of the second affixing means. The first U-shaped member receiving the first male clip member and the second U-shaped member receiving the second male clip member to form an enclosure encompassing a three dimensional object. The bumper means can either be proximate the U-shaped members or the first affixing means.

In another embodiment, the first U-shaped member is integral with one end of the first affixing means and a first male clip member is integral with the other end of the first affixing means. A second U-shaped member is integral with one end of the second affixing means and a second male clip member is integral with the other end of said second affixing means. Thus, the first U-shaped member receives the second male clip member and the second U-shaped member receives the first male clip member to form an enclosure encompassing a three dimensional object. The bumper means can be proximate the first affixing means.

Release means can be provided on any of the embodiments. The release means release the interlocking between the ridged receiving means and the ridged locking means, thereby allowing removal of the male clip member from the U-shaped female clip member.

A further embodiment discloses a load-dispersing device for use with a ladder which has a pair of spaced supports, each of the supports having a support surface and being separated by rungs. Each of the flexible load-dispersing members has a contact surface, with a width and depth, a locking surface with a width and depth, a length. The length has an interior cavity, equal to the length and has a configuration substantially equal to the configuration of the support surface. A full-length longitudinal slit, connects the interior cavity with the locking surface. The locking surface can be dimensioned to fit on said supports adjacent said rungs. The longitudinal slit can be contoured according to the design of the supports to allow the load-dispersing member to lie in contact with the supports. A spring, is placed within the depth of the contact surface.

The load dispersing device can further comprise a pair of caps, which have at one end of the length and are dimensioned to fit over the end of the support. The caps are an integral part of the lengths. Affixing means, which have a length and width equal to or slightly less than a portion of the interior cavity lying parallel to the contact surface can be added to adhere the device to the ladder.

BRIEF DESCRIPTION OF THE DRAWINGS

FIG. 6 is a transverse sectional view of an embodiment of this invention having interior cavities configured to fit snugly over the flanged side members of the ladder;

FIG. 7 is a transverse sectional view of an alternate embodiment an interior cavities configured to, receive multiple sized flanges;

FIG. 8 is a transverse sectional view of a further embodiment interior cavities which fit loosely over the ladder sides;

FIG. 9 is a transverse sectional view of an additional embodiment formed with ovoid an exterior and interior cavities;

FIG. 18 shows a transverse cross section of a further embodiment with a channel to accommodate the outer surface of the ladder and is affixed to the ladder by chemical adhesive;

FIG. 19 illustrates the embodiment of FIG. 18 using an adhesive strip or hook-and-loop fastener in place of the chemical adhesive;

FIG. 20 shows a transverse cross section of an embodiment made to extend over only the bearing fates of the ladder flanges, and affixed thereto by flexible dome-topped pins pushed through holes drilled in the ladder;

FIG. 21 shows a modification of FIG. 20 with the body of the device covering a portion of the ladder;

FIG. 22 shows a transverse cross section of a further embodiment made to extend over only the bearing faces of the ladder side member, shown having a rectangular configuration;

FIG. 23 is a alternate embodiment of FIG. 22, arranged to cover part of the sides of the ladder side;

FIG. 24 is a further embodiment of FIG. 22 used with a ladder having a semi-circular cross sections;

FIG. 25 is an alternate embodiment to FIG. 23 in use with a ladder having a semi-circular cross-section;

FIG. 29A is an exploded view of the spring clip of FIG. 29;

FIG. 34 is an exploded end view of interlocking bumper clip having a arched locking arms;

FIG. 35 is an end view of the interlocking bumper clip of FIG. 34 in the locked position;

FIG. 36 illustrates the clip of FIG. 35 having an alternate design in locking arms;

FIG. 37 illustrates the clip of FIG. 35 having a U-shaped and a S-shaped locking arms;

FIG. 37A illustrates the clip of FIG. 35 having small arched locking arms;

DETAILED DESCRIPTION OF THE PREFERRED EMBODIMENT

Figure 1:
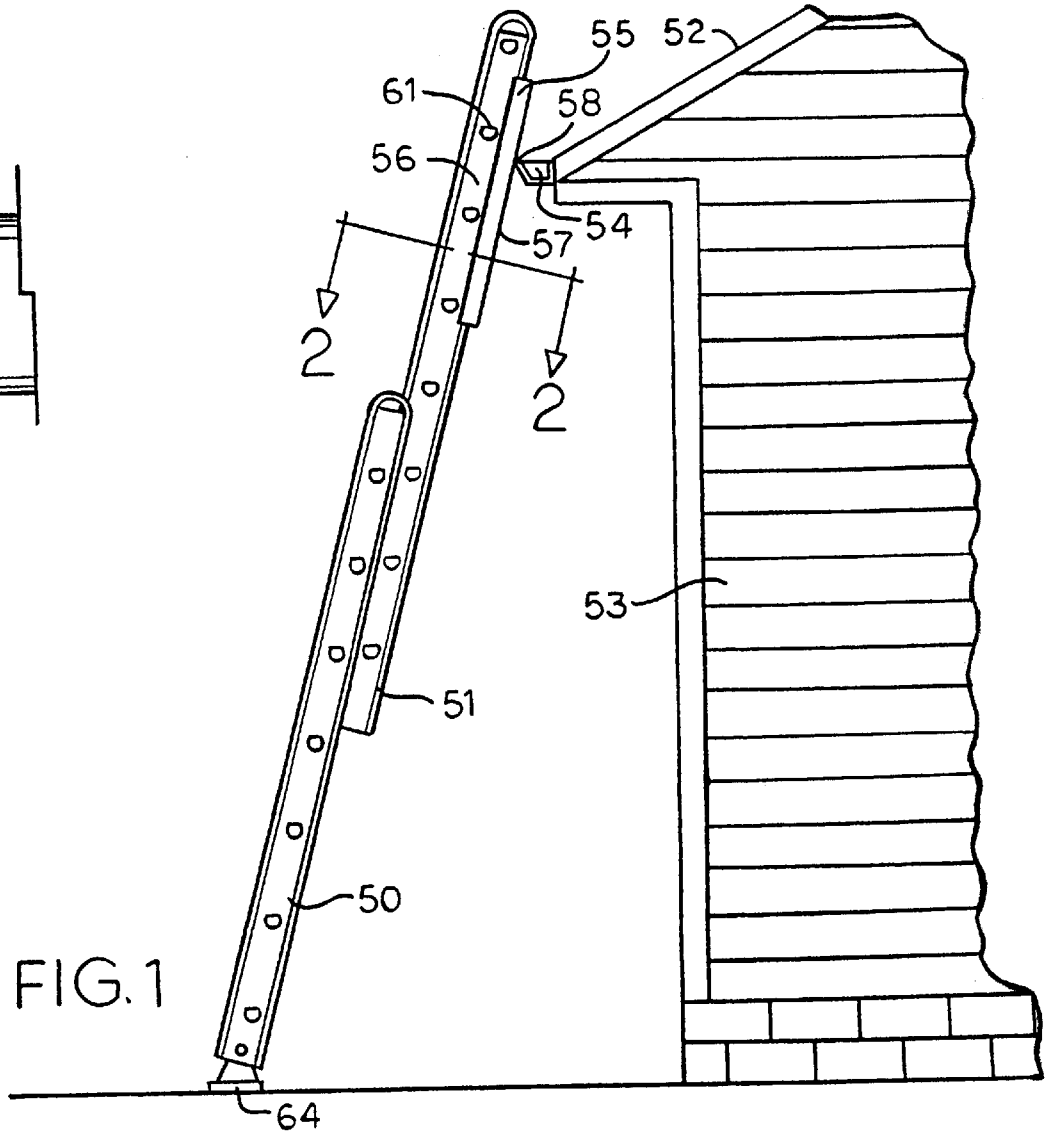
FIG. 1 is an side view of a ladder with fitted with the disclosed load-dispersing device.

This invention is directed to a load dispersing device for portable, non-free-standing ladders, as commonly used in the construction, maintenance and repair of buildings and other structures. The purpose of the disclosed device is to avoid damage to the upper support of a portable non-free-standing ladder and slipping of the ladder itself, while allowing the ladder installer opportunity to adjust the ladder to its required position for use. Various means of attaching the device to a ladder are illustrated in the drawings.

The load dispersing devices as disclosed herein are manufactured from a force absorbing, cushioning material. During use the ladders will undergo transverse movement as the user climbs the ladder, and any material used must have sufficient strength to prevent tearing, permanent indentations, etc. The material is preferably soft and flexible, such as foam rubber or foam plastic, having a surface of a high coefficient of friction. The material requires sufficient density to transfer the load thrust of the ladder against the supporting surface 58 to evenly distribute the load. Although, for ease of description only one load dispersing device length, or clip unit, is illustrated, it should be understood that both sides of the ladder, or other device, should be evenly equipped with a device or clip.

Referring to the embodiments of this invention as shown in the drawings, FIG. 1 shows an extension ladler, comprising conventional lower stationary section 50 and upper ladder section 51. The upper ladder section 51 is placed against the gutter 54, to gain access to the roof 52 of the building 53. A generalized illustration of one length of the load-dispersing device 55, is disposed along the side members 56 and between the gutter 54 and the upper ladder section 51.

Figure 2:
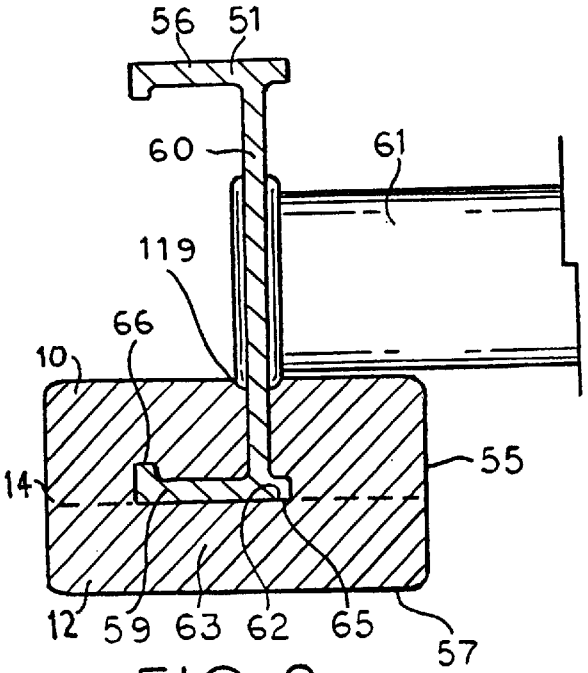
FIG. 2 is a transverse sectional view of the load dispersing device and ladder of FIG. 1.

FIG. 2 is a transverse cross section view taken on the line 2—2 of FIG. 1, and showing a cross section of the load dispersing device 55 fitted around the side member 56. The side members 56 of the illustrated ladder are manufactured with a flange 59 and a web 60. The flange 59 provides support for the rungs 61 and has upper support contact surface 62. It should be noted that since the device according to this invention does not exceed in depth the shortest distance between the ladder's upper support contact surface 62 and the side farthest from it of rung 61, the device does not impede the sliding of the lower section 50 along upper ladder section 51, irrespective of the length of the device. This provides an advantage over other prior art attachments for ladders which are thereby limited in length and/or utility when applied to sliding extension ladders. As can be readily seen, the load dispersing device 55 encloses the flange 59 and part of the web 60 and buffers the ladder contact surface 62 against the supporting surface, such as a gutter. In this example, thus interposing the load dispersing portion 63 of the device between the ladder's upper support contact surface 62 and the supporting surface 54 at the upper support contact area 58. The length of the load dispersing device 55 is preferably between 3 and 5 feet, although any length can be used. Obviously, the longer the length, the greater the height adjustability of the ladder along the supporting surface.

The load dispersal device 55 also prevents damage to the supporting surface 54 while the ladder is in use due to the softness, flexibility and high coefficient of friction of the materials used in manufacturing the preferred embodiments. Referring to FIG. 2, it can be seen that the supporting surface 54, bumper contact surface 57, and flange surface 62 are separated by the load dispersing body 63. The friction between contact surface 57 and contact area 58 is increased by the user's weight, making movement between contact surface 57 and the point of contact 58 less likely. The body 63 serves to absorb any shear force created at the point of contact 58 is reduced.

For ease of description, the body 63 is divided into two portions by line 14. The locking area 10 comprises the portion of the body 63 which is configured to open and wrap around the flange 59. The support area 12 is the area of the body between the flange surface 62 and the bumper contact surface 57. When manufactured, the load dispersal device is one piece and the division is for description only. To affix or remove the device 55, the support area 12 is curved, concave along contact surface 57, to open the slit 119 to expose the wall 65 of the cavity 66. When released the locking area 10 returns to its manufactured position, thereby encasing the flange 59 within the configured cavity 66.

The load dispersing device 55 maintains its position along the ladder sides 56 through friction between the flange 59 and web 60 the ladder and the internal wall 65 of the device. In this embodiment, the device 55 has an interior cavity 66 which is configured to correspond to the design of the flange 59 and the web 60. The flexibility of the material of the device 55 is such that it is fitted over flange 59 and the portion of web 60 by stretching open the full-length longitudinal slit 119 of the wall 65, exposing the longitudinal interior cavity 66, wide enough to admit the flange 59 and web 60. When the cavity 66 returns to its unstretched state, the wall 65 fits snugly around and against the whole of the flange 59 and a portion of the web 60. As the material used to manufacture the device 55 has a high coefficient of friction, the device is prevented from slipping along the ladder sides 56.

The material of the lengths comprised in the device according to this invention may be any suitable soft, flexible material with a surface of a high coefficient of friction, for example foam rubber or foam plastic. However, the device may be made of a combination of different materials, for example the material of the upper support contact face of the device is more durable or less flexible than the portion of the device which affixes the device to a ladder.

Figure 3:
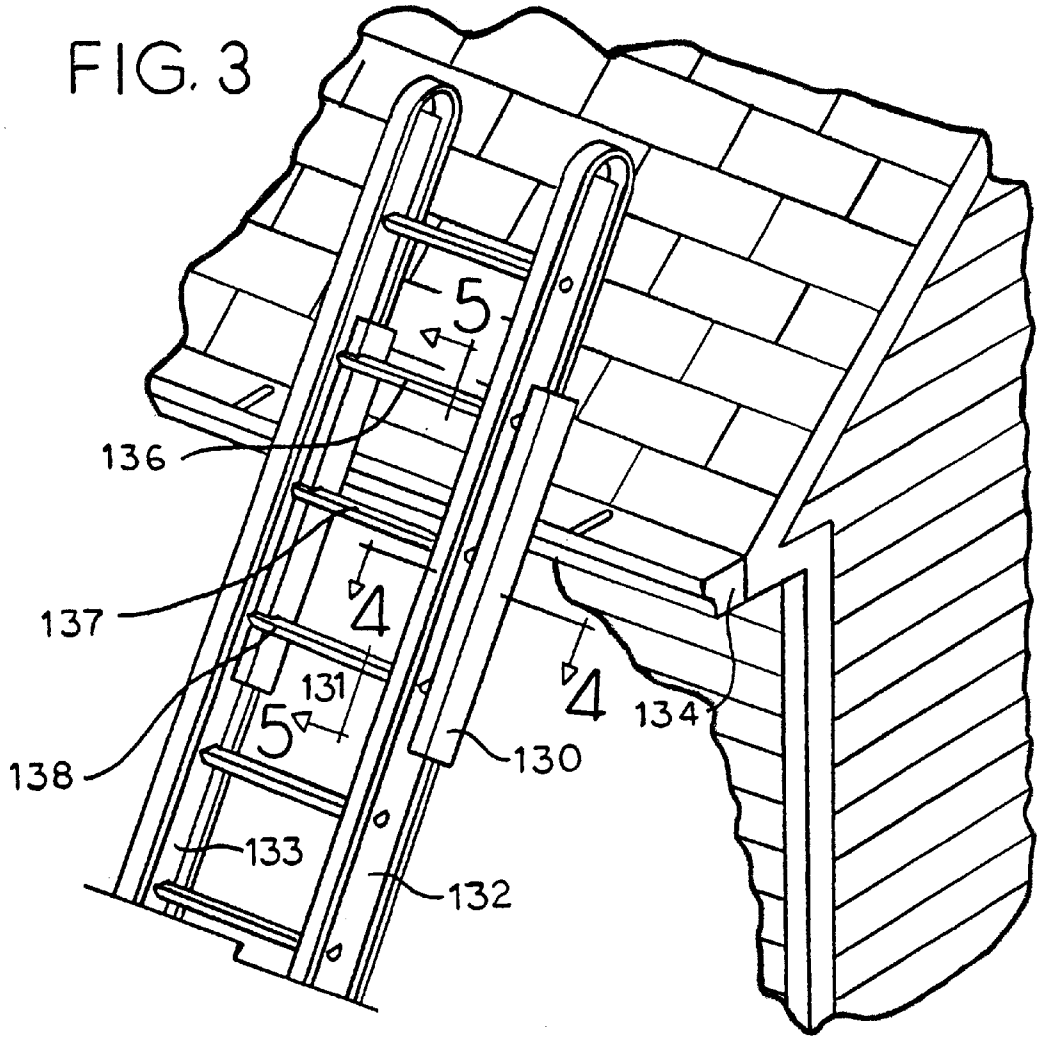
FIG. 3 is a perspective view showing a ladder carrying an alternate embodiment of the invention comprising cut out portions to accommodate the ladder rungs.
Figure 4:
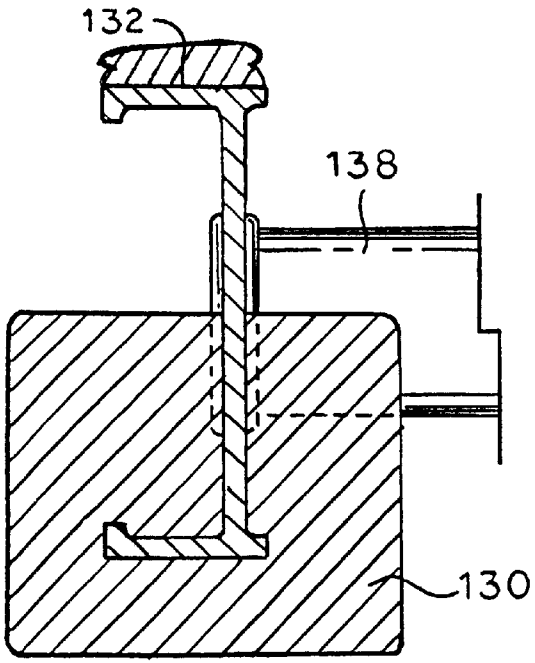
FIG. 4 is a transverse sectional view of the embodiment of FIG. 3.
Figure 5:
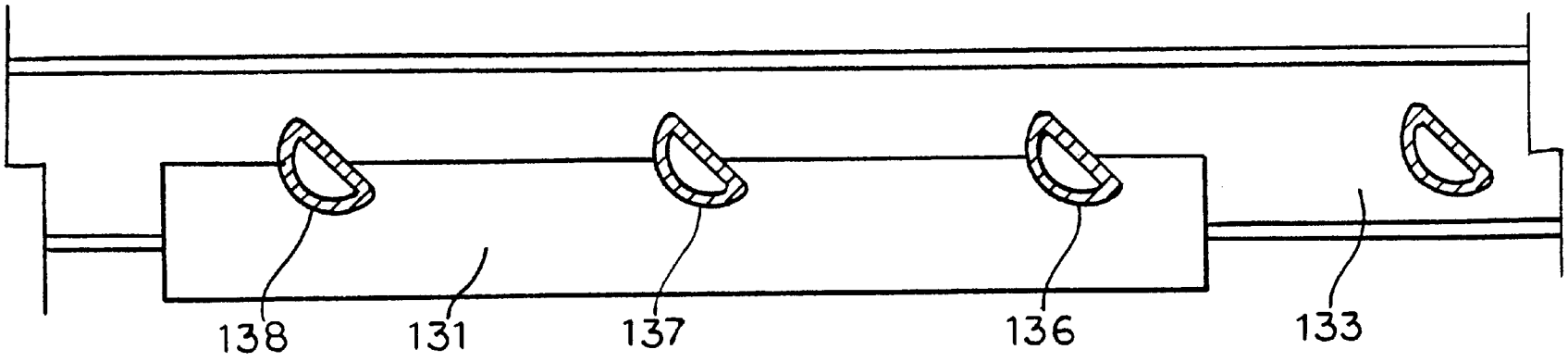
FIG. 5 is side view of the embodiment of FIG. 3 fitted on a ladder.

FIGS. 3, 4 and 5 illustrate an embodiment of this invention which is identical in function to that illustrated in FIGS. 1 and 2, except that the device 131 partially enclose the ladder's rungs 136, 137 and 138. The enclosure of the rungs serves to locate the device 131 and hold it in position in place of, or as a supplement to, the affixing means already described. Referring to FIG. 3, the devices 130 and 131 are located along ladder side members 132 and 133, interposed between side members 132 and 133 and the ladder's upper support 134. It is clear that the devices 130 and 131 when installed in this fashion cannot move in a longitudinal direction, because such movement would be prevented by the rungs 136, 137 and 138. For clarification FIG. 4 shows in transverse section on the line 4—4 of FIG. 3, device 130 arranged on ladder side member 132, and enclosing a portion of rung 133. For further clarification, FIG. 5 shows a longitudinal section on the line 5—5 of FIG. 3, in this case illustrating device 131 located on side member 133 by, and partially enclosing, ladder rungs 136, 137 and 138.

FIG. 6 illustrates an embodiment showing the length 140 having a full-length longitudinal cavity 142 forming 144 and full length longitudinal slit 146, the lengths 140 is made of a soft, flexible material of a high coefficient of friction such as foam rubber or foam plastic. Partially enclosed within the cavity 142 is ladder side member 150.

FIG. 8 shows a similar view to that of FIG. 6 but wherein the cavity 155 of the length 156 is configured to fit loosely about the flange 154. In this figure the length 156 is located on the web 160 by full-length longitudinal slit 158 through which the flange 154 is unable to pass unless the slit 158 is opened.

Figure 10:
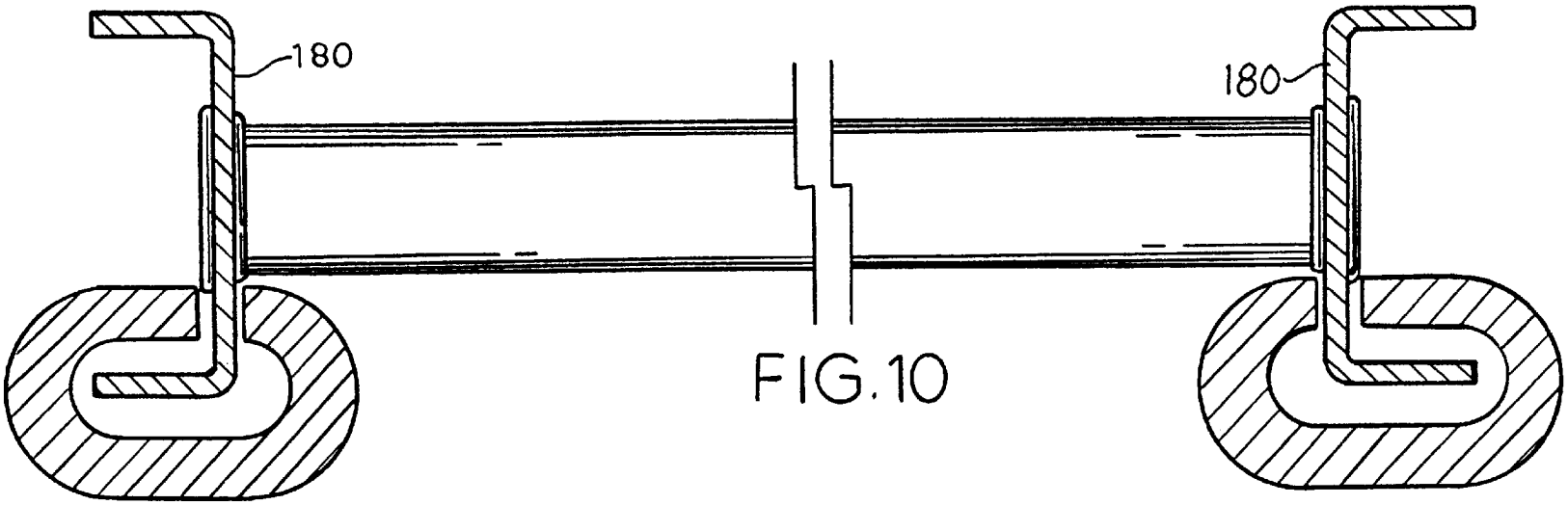
FIG. 10 is a transverse sectional view of the embodiment of FIG. 9 used in conjunction with a standard fiberglas ladder.

In FIG. 9 the device 171, the inner walls 173 and outer surface 175 create an ovoid. The device 171 contains a full length longitudinal slit 177 which can be opened to admit or remove the flange 155. FIG. 10 shows the same embodiment of the invention as FIG. 9, but mounted on a ladder having a fiberglas side member 180.

Figure 11:
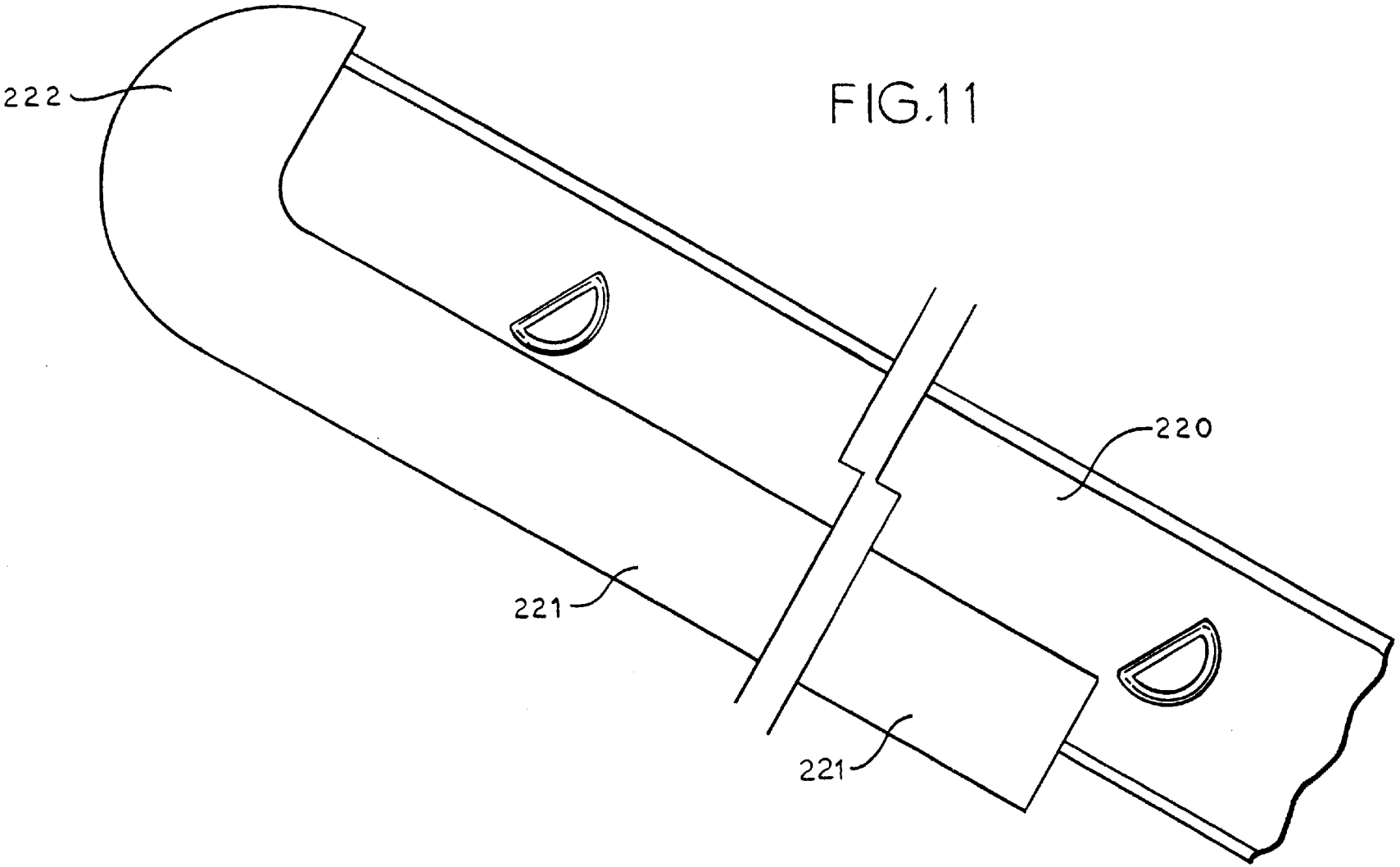
FIG. 11 is a side view of the upper end of a ladder fitted with an embodiment containing integral caps that are fitted over and accommodate the ladder's upper ends.

FIG. 11 shows a ladder side member 220 on which is mounted a length 221 having a cap 222 arranged on the upper end of the length enclosing the end of ladder side member 220. Cap 222 may be molded in one piece with length 221, or may be affixed in any way appropriate to the respective materials, which may be the same, of the length 221 and the cap 222. Cap 222 protects the end of the ladder and the ladder's supporting surface, if the supporting surface is, for example a brick wall or painted siding.

Figure 13:
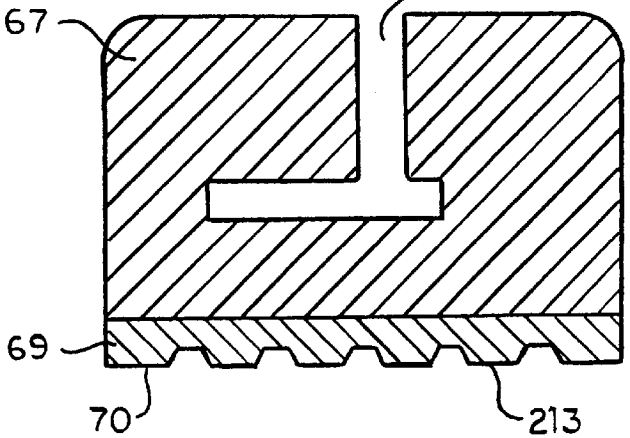
FIG. 13 is a transverse cross sectional view of a another an embodiment having a support contact surface manufactured from a different material than the body.

An example of the use of multiple materials is illustrated in FIG. 13 wherein the body 67 is made of soft, flexible material and contains the cavity 68 which is opened to fit over a ladder side member. The contact element 69 is made of a more durable, and possibly a less flexible material, for example solid rubber or plastic, and is affixed to body 67. The higher durability of contact element 69 is desirable in that its contact face 70, which is shown with exemplary grooves in this illustration, comes in contact with the supporting surface. Using multiple materials allows the contact element to be manufactured from a material having a high coefficient of friction to avoid slipping, while body 67 is manufactured from an resilient material to absorb the shear forces generated by such slip resistance.

Figure 15:
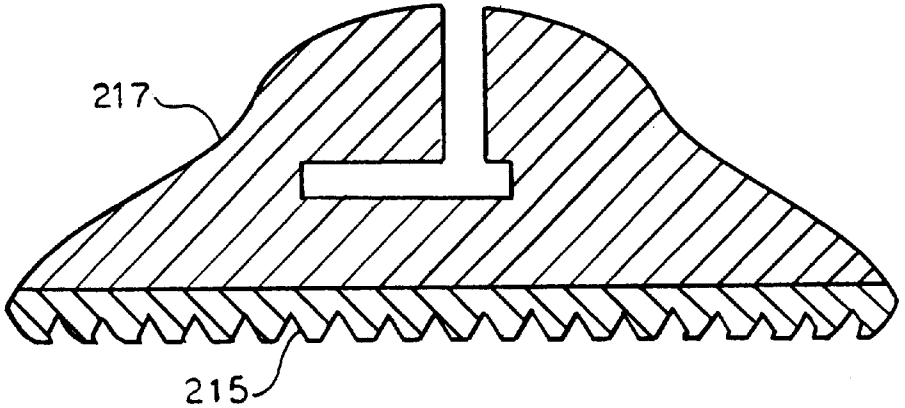
FIG. 15 shows FIG. 14 without the internal resilient strip and with the support contact surface flattened as by pressure of a ladder.
Figure 14:
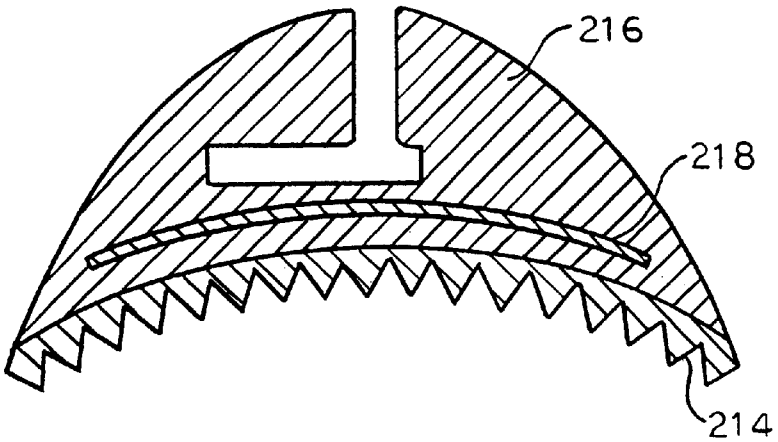
FIG. 14 is a transverse cross sectional view of a further an embodiment having a patterned support contact surface of concave form when unloaded and showing an internal resilient stiffening rib.

FIGS. 13, 14 and 15 show examples of patterned upper support contact surfaces 213, 214 and 215 respectively, which in these examples are grooved longitudinally in respect of the lengths 67, 216 and 217 respectively. Many different patterns can be utilized for contact surfaces, including the flat surfaces shown in FIGS. 2, 4, and 6 through 10. Also applicable for use are flat surfaces which are roughened, or any other surface which will improve non-slipping contact with the ladder's upper support.

FIGS. 14 and 15 illustrate embodiments in which upper support contact surfaces 214 and 215 respectively have a concave form when unloaded, as illustrated in FIG. 14. As described above, contact surfaces 214 and 215 are shown patterned with grooves, but they may be made in any other appropriate pattern or made unpatterned. FIG. 14 shows length 216 unloaded, while FIG. 15 shows the shape of a length of similar cross sectional shape under load. The upper support contact surface 215 is generally flattened into planar form and slightly stretched under load. In FIG. 15 the teeth of the grooves of upper support contact surface 215 serve to show the distortion under load which improves the softness, accommodates small irregularities in the contact area of the ladder's upper surface and decreases the tendency to slip. FIG. 14 also shows a concave longitudinal spring 218 molded internally in length 216, to assist in distributing the load of the ladder to a greater area of the ladder's upper support surface. The spring 218 serves to reinforce the length 216 and to assist the return of the contact surface 214 to concavity after release of the load.

Figures 16, 17:
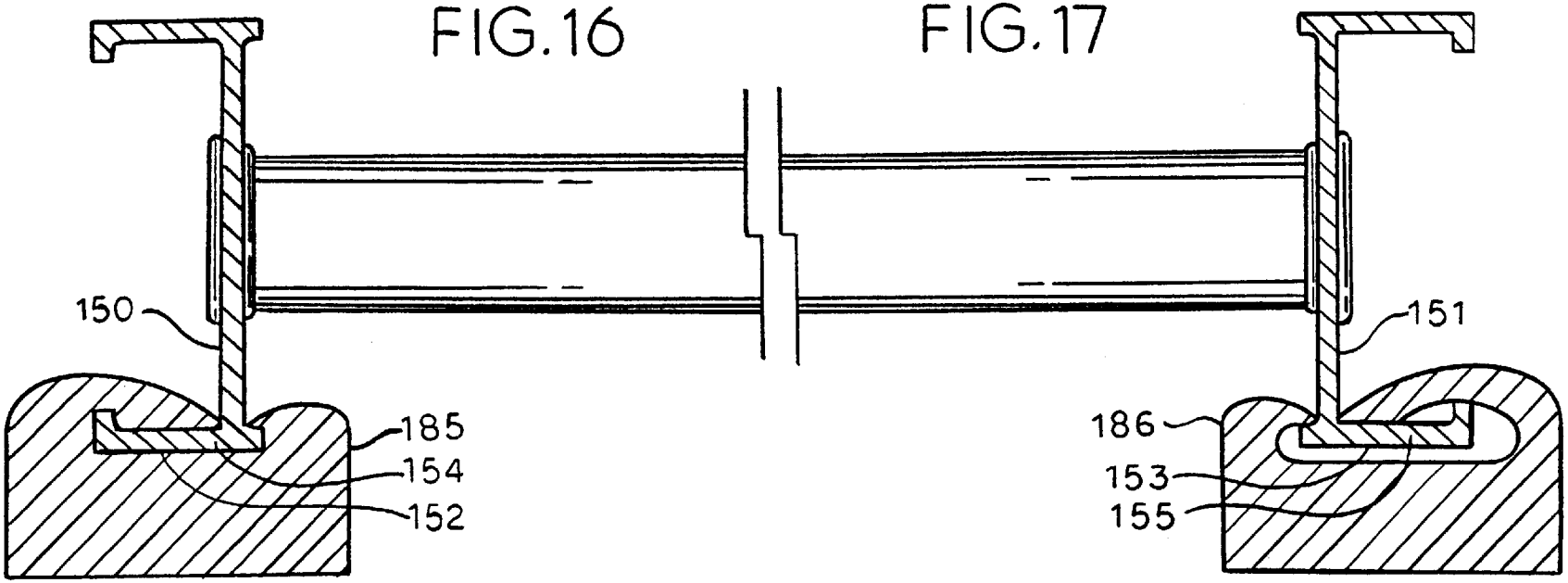
FIG. 16 shows a transverse cross section of a length of an embodiment designed to snugly enclose a ladder side without impinging on the web of the ladder.
FIG. 17 shows a transverse cross section of an embodiment designed to loosely enclose a ladder side member without impinging on the web.

FIGS. 16 and 17 illustrate embodiments wherein the device lengths 185 and 186, mounted on a ladder with flanged side members 150 and 151. The lengths 185 and 186 are supported by wrapping around the respective flanges 154 and 155. The difference between the respective embodiments shown in FIGS. 16 and 17 is that in the embodiment illustrated by FIG. 16 length 185 fits snugly around the whole of flange 154, whereas in FIG. 17 length 186 fits loosely around the whole of flange 155.

In FIG. 18 the length 76 has a recessed channel 77 to receive the side member flange 80. The base! 78 of channel 77 is provided with a chemical adhesive 79 for affixing the length 76 to the flange 80. It can be seen that, as the channel 77 is recessed within the length, adhesive 79 or some other affixing means is necessary to retain length 76 in place. A similar example is shown in FIG. 19, wherein the affixing means 81 may be either a conventional double-sided adhesive strip or a conventional hook-and-loop fastener.

FIGS. 20 and 21 illustrate embodiments in which the affixing means for lengths 103 and 104 are a longitudinal series of flexible dome-topped pins 101 and 102 respectively. The dome-topped pins 101 and 102 are attached along the flange contact surfaces 107 and 108. The dome-topped pins 101 and 102 are dimensioned to fit into corresponding holes 109 and 110 which are drilled in the respective flanges 105 and 306. The respective holes 109 and 110 each have a diameter equal to the minimum diameter portions 113 and 114 of the pins 101 and 102. The minimum diameter portions 113 and 114 have a length equal to the thickness of flanges 105 and 106. The holes 109 and 110 are drilled along the flanges 105 and 106 to match the spacing of the dome-topped pins 101 and 102. The flexibility of the domed tops 111 and 112 enable them to be pushed through the corresponding holes 109 and 110. Once pushed through, the domed tops 111 and 112 expand to lock the lengths 103 and 104 into longitudinal alignment along flanges 105 and 106.

Figure 12:
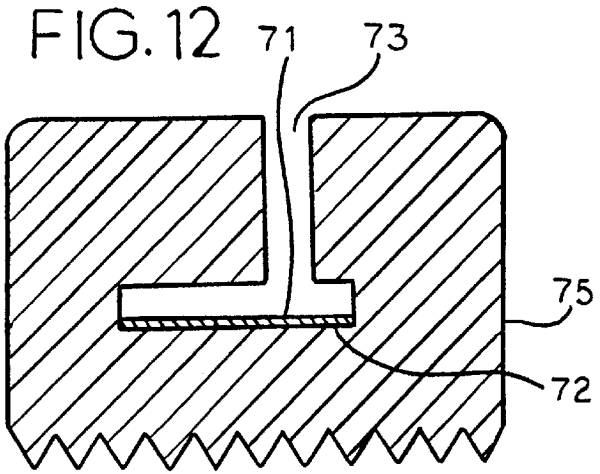
FIG. 12 is a transverse cross sectional view of an embodiment having an adhesive or other fastener arranged on and along the lowest surface of its internal cavity.

Within the scope of this invention, the transverse cross sections of the pair of lengths comprised in the device according to the invention may be manufactured in many different shapes, all facilitating ladder installation, and avoidance of damage and slipping. Examples of the different shapes are illustrated in FIGS. 2, 4, and 6 through 25. The different shapes of the cross sections and different materials in which the device is manufactured may require longitudinal affixing means different from the affixing by frictional means as already described. For example, the device of FIG. 12 uses a longitudinal affixing means 71 arranged on a portion 72 of the wall of the cavity 73 for the purpose of affixing the device 75 to the flange of a ladder. The longitudinal affixing means can include an adhesive suitable, a conventional double-sided adhesive strip, a strip of conventional hook-and-loop fastener or other means which will be evident to those skilled in the art.

In FIG. 22 the length 84 has a rectangular transverse cross sectional shape without a cavity. The length 84 is directly mounted onto the rectangular box-section ladder side member 86 and retained in position by an affixing means 82, such as set forth heretofore. In FIG. 23 the length 835 is provided with a recessed channel 88 dimensioned to fit around the rectangular box-section ladder side member 87. The affixing means 83, as described, are used to maintain the length in position. FIGS. 24 and 25 show similar modes of affixing means 89 and 90 respectively for similar embodiments 91 and 92. The ladders in FIGS. 24 and 25 have hollow, roughly semicircular side members 93 and 94 respectively; FIG. 24 being with external longitudinal ribbing and FIG. 25 without external ribbing.

The device according to this invention is equally useful for the ladder types illustrated in FIGS. 22, 23, 24 and 25 which are generally of the folding type, as it is for sliding extension ladders with flanged side members. FIG. 7, as an example, shows the type of flanges 96 that are commonly found on ladders with fiberglas side members, and lengths 98 respectively have their cavities 100 respectively made to conform thereto.

The load dispersing devices disclosed in FIGS. 26–39 are two piece clip units which extend along a portion of the length of the ladder. The dimensioning, as far as length and contact surface are, as with the foregoing embodiments, dependent upon end use.

Figure 26:
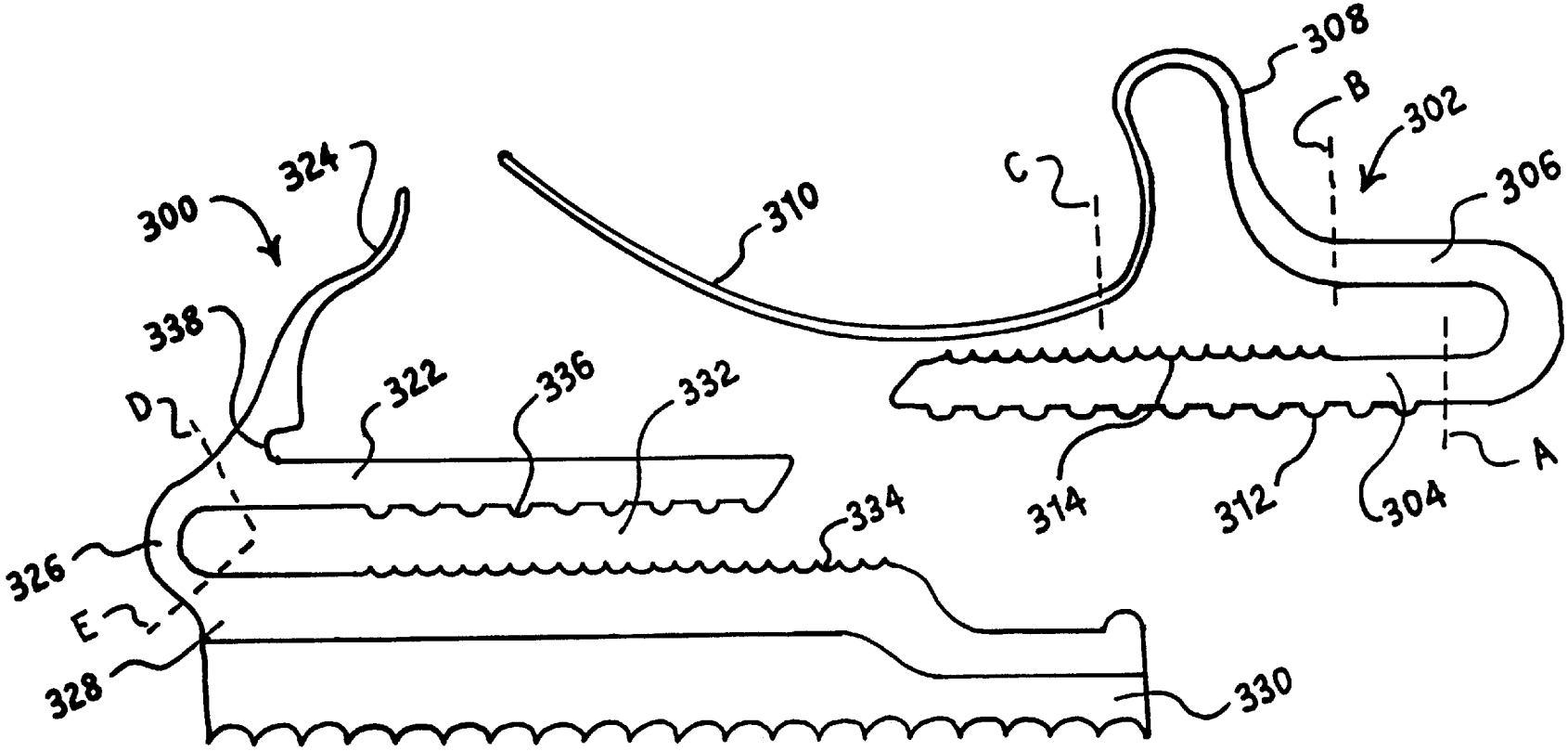
FIG. 26 is an exploded end view of the disclosed two piece bumper clip.
Figure 27:
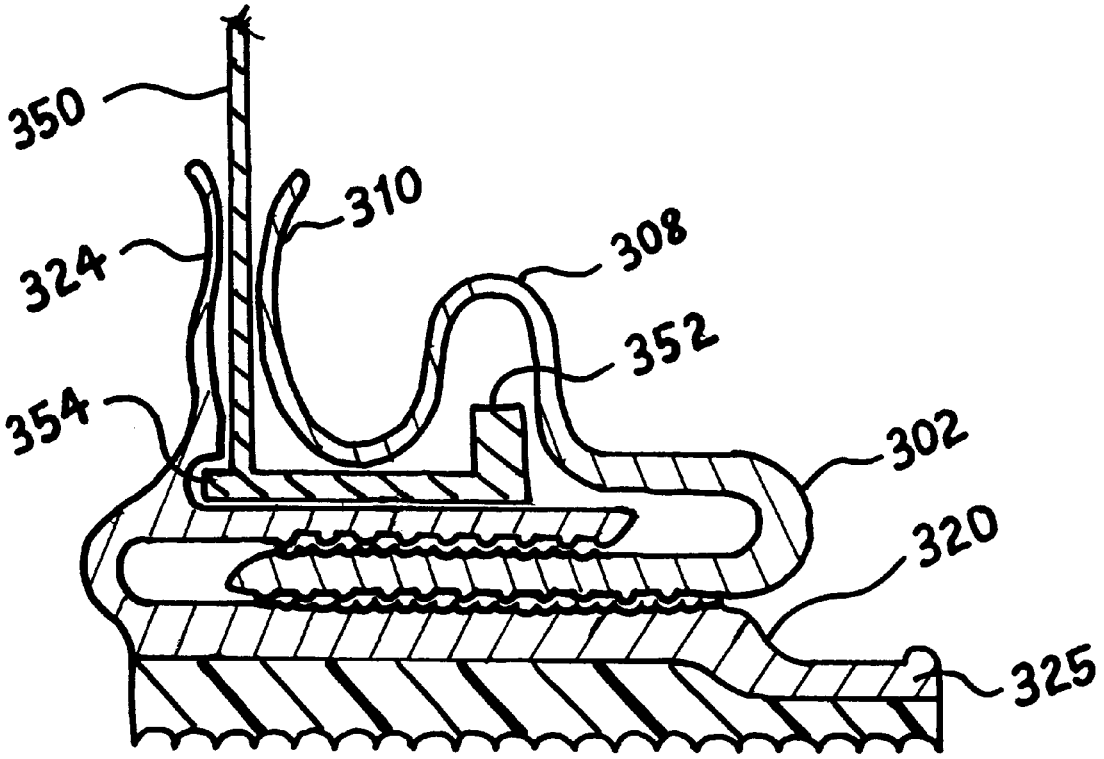
FIG. 27 is a cutaway end view of the two piece clip of FIG. 26 placed on a L-shaped ladder having a lip and heel.
Figure 28:
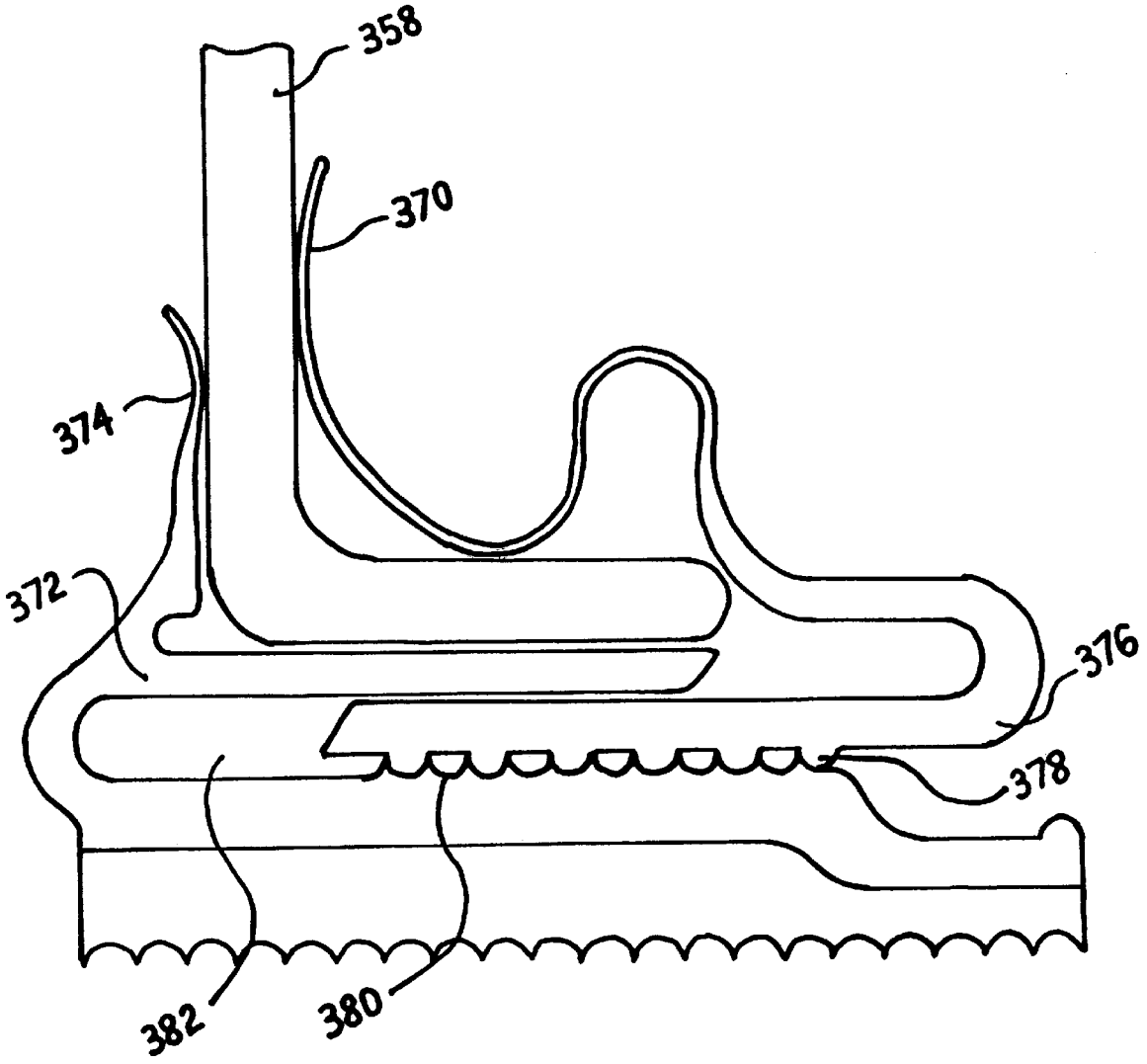
FIG. 28 is a cutaway end view of the two piece clip of FIG. 26 placed on a L-shaped ladder.

The clip unit 300 as shown in FIGS. 26, 27 and 28 is a two piece unit which snaps around the ladder side 350 of FIG. 27 and ladder side 358 of FIG. 28. Due to the intricate shape of the clip unit 300, the clips 302 and 320 have been divided by lettered lines into sections. It should be noted that these sections are used for ease of description only and that they are not, in any way, intended to reflect on means of manufacture or to limit the scope of the invention.

As easily seen in FIG. 26, the clip unit 300 consists of a male locking clip 302 and a female bumper clip 320, which interlock through the interaction between a toothed flange 304 and toothed channel 332. The locking clip 302 has a flange 304 which is, in this embodiment, provided with teeth 312 along one outer surface and tooth receiving indents 314 along the opposite outer surface. The locking body 306 of the locking clip 302, defined as the area between dividing line A and dividing line B, is curved in a U-shape. From the locking body 306 extends the frame arc 308, defined between dividing lines B and C, which then extents into the spring lock 310, extending from dividing line C to the end. The locking body 306 and flange 304 are relatively rigid sections and have a heavier gauge than the frame arc 308 and spring lock 310. During operation, the locking body 306 and the flange 304 both need to remain in a generally fixed position. Some flexibility is optimal to prevent breakage, however most heavy duty plastics provide the necessary flexibility. Too much flexibility weakens the unit and diminishes the locking capabilities. The frame arc 308 and spring lock 310 have a thinner cross-sectional width to allow for the creation of a spring action. The material used for the clip unit 300 should have memory, and is especially important in the frame arc 308 and the spring lock 310. In the preferred embodiment the locking clip 302 and the bumper clip 320 are manufactured from one material, although more than one material can be used.

The purpose of the spring lock 310 and frame arc 308 is to prevent movement of the locking clip 302 within relation to the ladder side 350 or ladder side 358. The frame arc 308 serves a dual purpose, first to provide clearance for the lip 352 of the ladder and second to enhance the spring affect.

The bumper clip 320 is the mating, female portion, of the clip unit 300. The bumper base 328 provides a surface for the attachment of the bumper 330 on one linear surface and toothed indents 334 on the opposite linear surface. The bumper base 328 illustrated is curved at the open end to create finger grip 323 for releasing the flange 304 from the bumper clip 320. By pulling down on the finger grip 323, the bumper base 328 is pulled away from the flange 304, releasing the interlocking means and allowing the flange 304 to be removed from the channel 332. The bumper base 328 curves to form a U-shape, as indicated at bend 326 between dividing lines D and E. This allows the upper body 322, in combination with the bumper base 328, to form the toothed channel 332. The locking flange 324 extends at approximately a 45 degree angle from the surface of the upper body 322. The locking flange 324 has a cross-sectional width less than that of the upper body 322 to allow for flexibility. A notch 338 is provided at the connection point between the upper body 322 and the locking flange 324 to accommodate the configuration illustrated as ladder side 350. The flange 324 provides the opposite lateral locking action to the spring lock 310, thereby preventing any lateral movement of the clip unit 300 when affixed to the ladder sides 350 or 358.

Although the teeth 336 are illustrated as part of the upper body 322 and the toothed indents 334 are part of the bumper base 328, the placement is not critical. The critical feature is that the teeth and toothed indents of the bumper clip interact with the teeth and toothed indents of the locking clip. Therefore, the placement and configuration of the design shown is for illustration purposes only and any spacing, arrangement or configuration can be incorporated and will be apparent to those skilled in the art.

The locking clip 302 and bumper clip 320 are illustrated placed on ladders 350 and 358 in FIGS. 27 and 28. The ladder 350 is a L-shape with a heel 354 and lip 352. As stated heretofore, the 308 serves not only to provide for the tension action required to maintain the clip unit 300 in place, but to provide clearance for the lip 352 when required. Although the notch 360 is not required when the unit 300 is used with the configuration of ladder 358, it is required to accommodate the heel 354 of ladder 350. As can be seen from FIGS. 27 and 28, the locking flange 324 and spring lock 310 serve to lock the clip unit 300 in place. By retaining memory, the combination of the spring lock 310 and the frame arc 308 place pressure against the ladder 350 and 352. On the opposite side of the ladder web, the flange 354 applies pressure to return to its approximately 45 degree angle rather than the 90 degree angle into which the flange 354 is forced when attached to the ladder 350. Thus, the pressure created by the flange 324 and the spring lock 310 on either side of the ladder web prevents any side to side movement of the clip unit 300. The clip unit 300 is prevented from movement along the length of the ladder 350 by the pressure exerted by spring lock 310 and frame arc 308.

By providing a number of teeth and receiving ridges along the toothed channel 332 and the toothed flange 304, adjustability is provided. The flange 304 is inserted into the channel 332 until the flange 324 comes in contact with the ladder web on one side and the lip or flange of the ladder comes in contact with the locking body 306. This provides the adjustability for the clip unit 300 to be used with ladders having various sized flanges as well as various configurations.

In FIG. 28, although the same basic configuration as FIGS. 26 and 27, the teeth on both the upper body 372 and the flange 376 have been modified. The upper body 372 is a smooth surface which mates with the smooth upper surface of the flange 376. The lower surface of the flange 376 is provided with ridges 378, such as teeth, undulations or any other interlocking configuration known in the art. The lower portion of the toothed channel 382 is provided with interacting receiving notches 380 which interact with the ridges 378 of the flange 376.

As illustrated the bumper 330 and the bumper base 328 are different materials and can either be extruded together at time of manufacture or adhered at a later date. The bumper 330 can, in some instances, be manufactured from the same material as the remaining portions of the clip unit 300, depending upon the end use.

Figure 29:
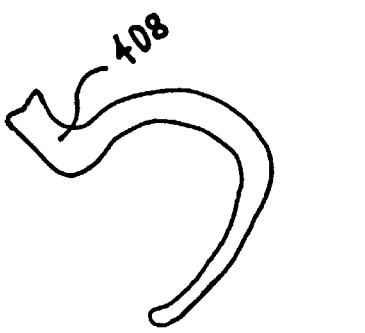
FIG. 29 is a cutaway end view of the two piece bumper clip having mirror image spring locking devices.
Figure 29:
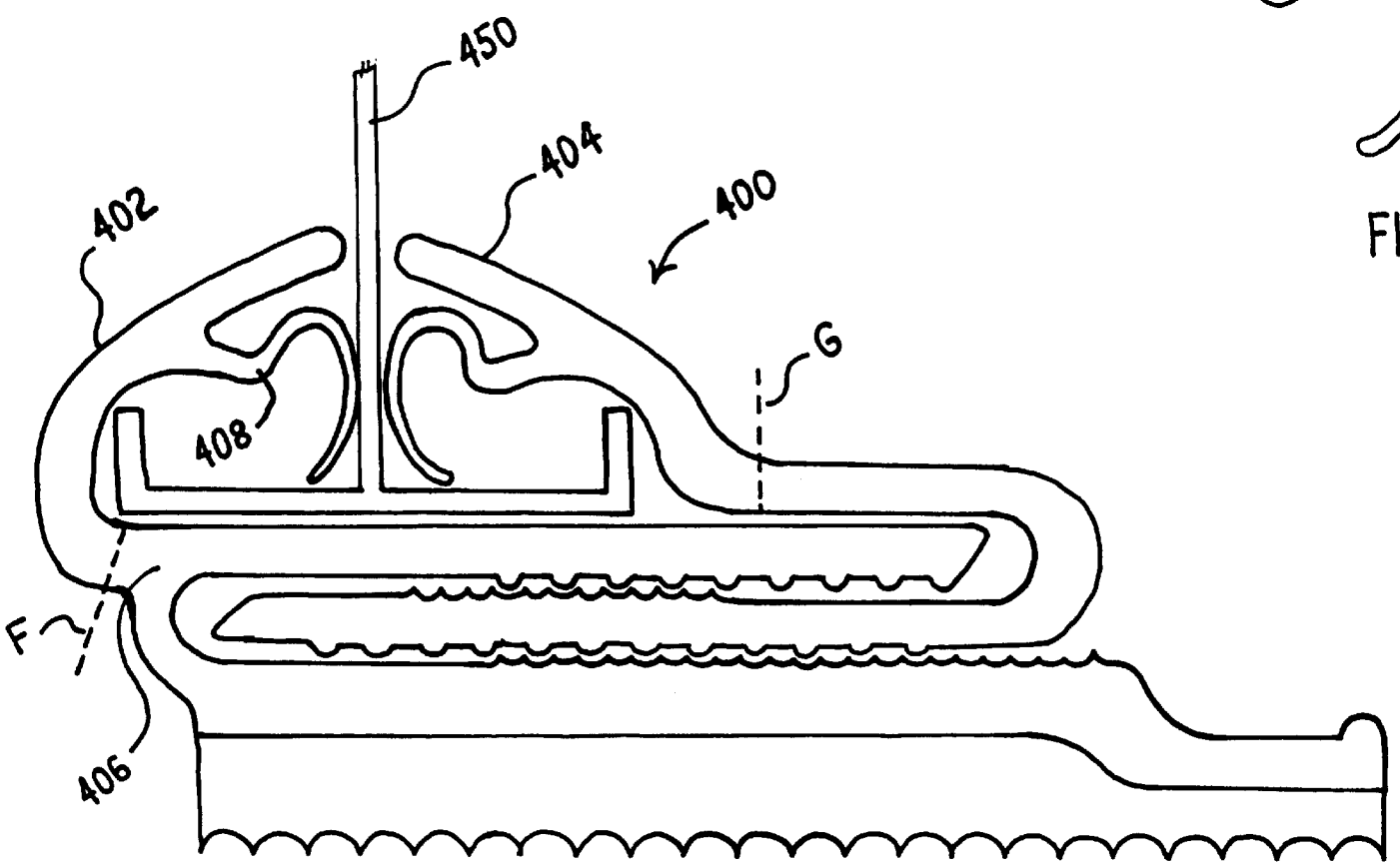
Figure 30:
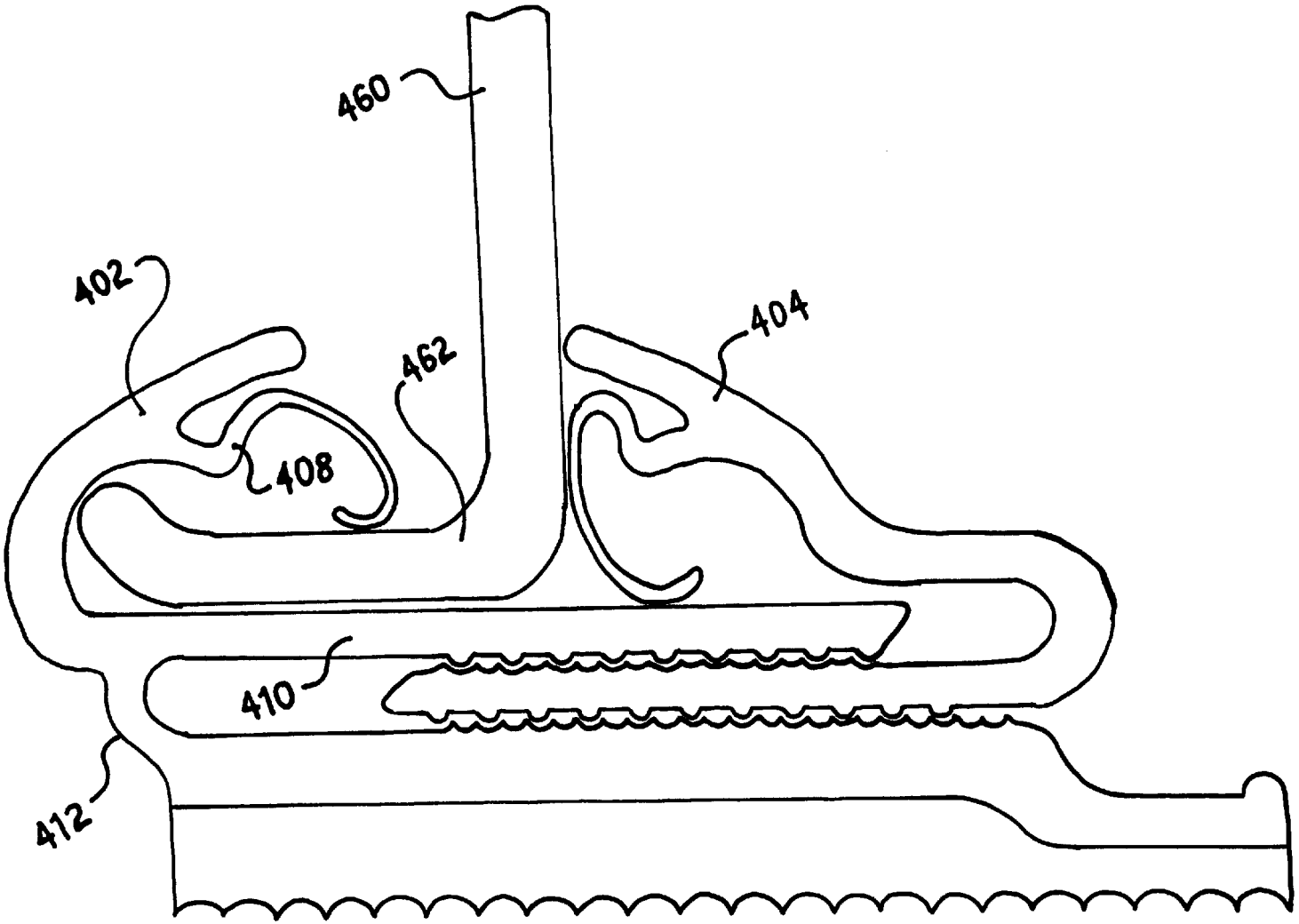
FIG. 30 is a cutaway end view of the clip of FIG. 29 used with a L-shaped ladder.

FIGS. 29, 29A and 30 illustrate the clip unit 400 used on a ladder 450 with a T-shaped configuration and a ladder 460 with a L-shaped configuration. The clip unit 400 is manufactured basically the same as the clip unit 300, except for the locking arms. The flange 324, frame arc 308 and spring lock 310 have been replaced with flange locks 402 and 404. For purposes of description, flange lock 404 begins at dividing line G and flange lock 402 begins at dividing line F. The flange lock 402 extends and curves from the female clip body 406 in approximately a quarter circle. A hook lock 408 extends from the flange lock 402, extending toward the female clip body 406. The hook lock 408 works in the same theory as the spring lock 310. The hook lock 408 is illustrated separately in FIG. 29A, more clearly showing the larger arc. The pressure created by confining the hook lock 408 to the confined space of the ladder 450 maintains the clip unit 400 in place. The hook lock 408 can be identical on both sides, or dependent upon end use, one side can be designed to create less tension. The flange lock 404, as designated by dividing line G, is designed slightly differently to accommodate use with the T shaped ladder 450. The illustrated carve is used for example and can be modified, or eliminated, depending upon end use.

As seen in FIG. 30, the flange locks 402 and 404 can be used with the L-shape ladder 460 due to the slight flexibility of the flange locks 402 and 404. The length of the hook locks 408 must be sufficient to come in contact with the ladder flange 462 even with the angle increase between flange locks 402 and 404 and the upper base 410 of the female clip 412. Although the flexibility of the hook locks 408 and the flange locks 402 must allow for the variations in size of the ladder flanges, they must maintain memory of their original position. This memory creates, as described heretofore, the pressure required to resist the movement of the bumper clips disclosed herein in relation to the ladder sides.

Figure 33:
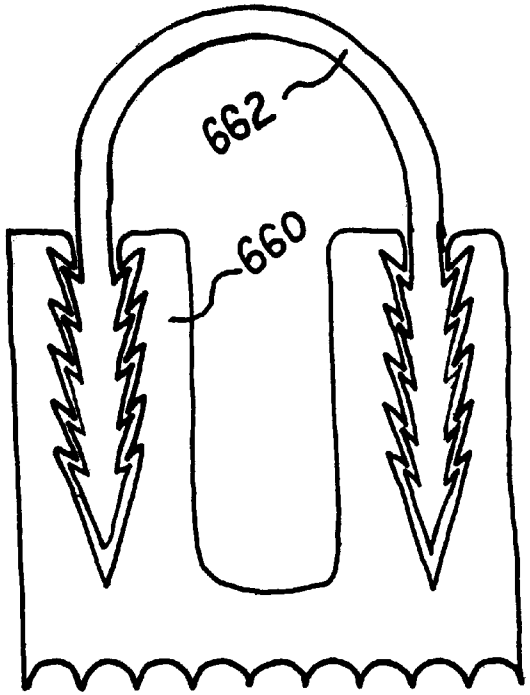
FIG. 33 is a cutaway end view of a U-shaped locking clip having alternate locking ridges and a single material construction.
Figure 32:
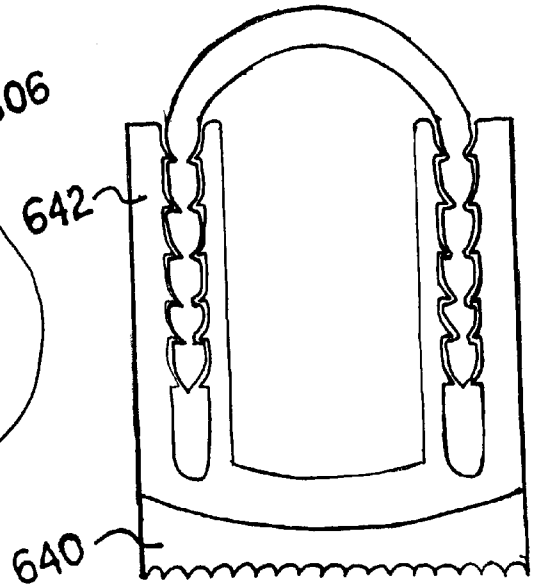
FIG. 32 is a cutaway end view of a U-shaped locking clip having a single bumper.
Figure 31:
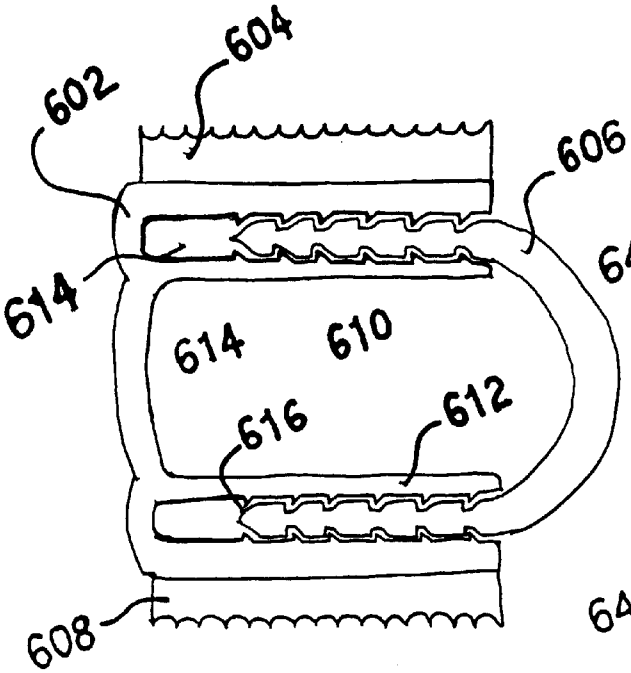
FIG. 31 is a cutaway end view of an alternate embodiment using a U-shaped locking clip and dual bumpers.

FIGS. 31–37 illustrate alternate embodiments of the device disclosed heretofore. In FIG. 31, the bumper body 602 is a U-shaped device with bumpers 604 and 608 along both legs 610 and 612. The center of the legs 610 and 612 is provided with notched receiving channels 614 and 616 to receive, and retain, the U-lock 606. The U-lock is provided with notches which correspond to the notches within the receiving channels 614 and 616. The clip of FIG. 32 is essentially the same design as disclosed in FIG. 31, however, the bumper 640 is at the bottom of the U-shaped device 642. In FIG. 33, a different notch arrangement is utilized between the U-shaped device 660 and the U-lock 662. Additionally, the U-shaped device 660 has no separate bumper, but rather is manufactured from a material which can also serve as a protective bumper unit.

The bumper clip 700 as illustrated in FIGS. 34 and 35 are designed for use with various surfaces, such as automobile roof racks, which require protection. The clip 700 consists of a female receiving clip 720 and a male locking clip 722. The receiving clip has a U-shaped body 704, the interior of which is ridged with teeth 712. A bumper 702 is affixed to one side of the U-shaped body 704 along the length. A curved locking section 706 extends at approximately 45 degrees from the body 704 opposite the bumper 702. The male locking clip 722 consists of a ridged locking flange 708 and curved locking section 710. The dimensions of the locking flange 708 is dimensioned to fit within the interior of the U-shaped body 704 and interact with the teeth 712. When assembled, as illustrated in FIG. 35, the locking section 706 and locking section 710 overlap, forming a half circle.

Figure 38:
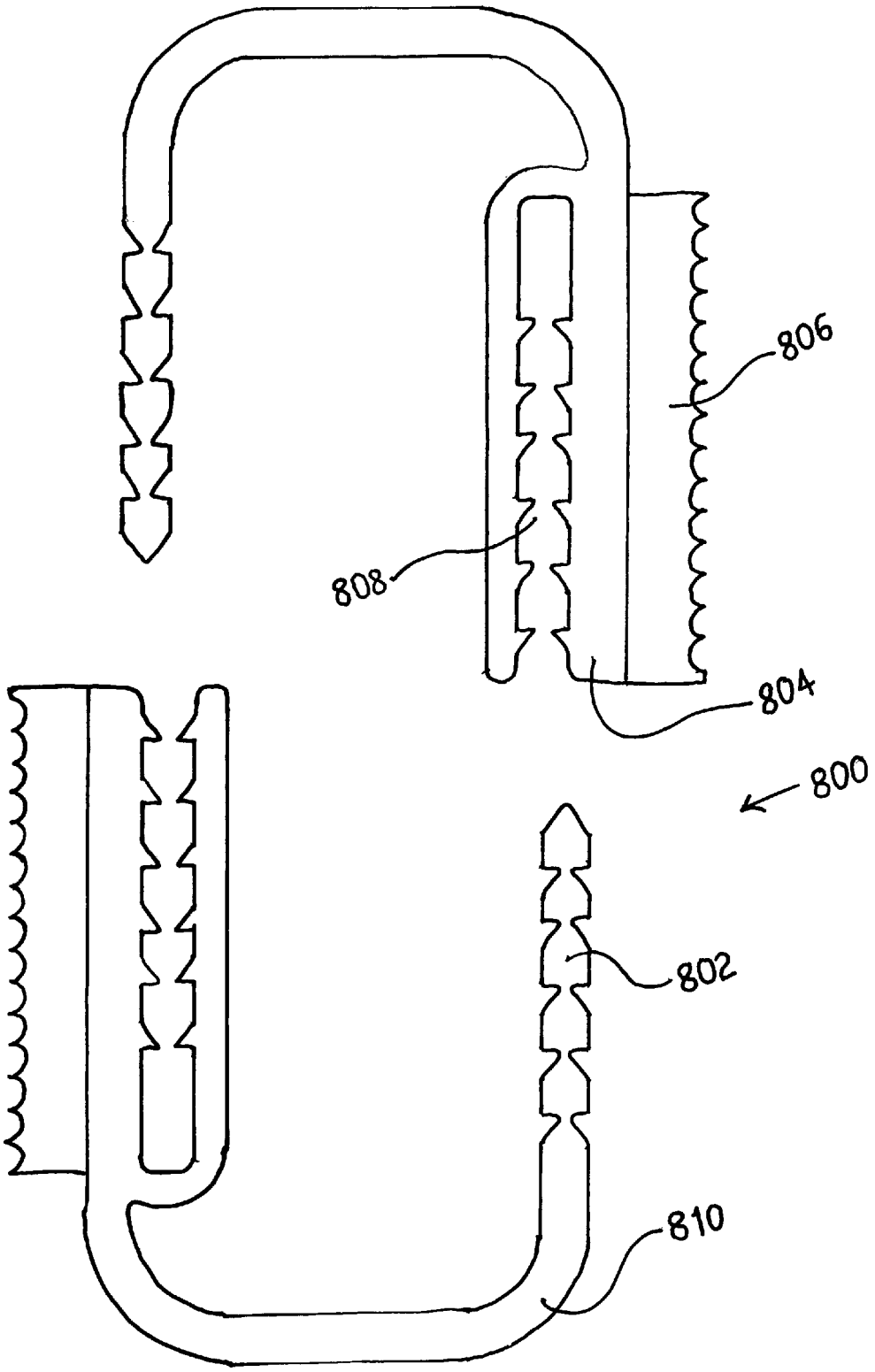
FIG. 38 is an exploded side view of a mirror image clip.

In the embodiments illustrated in FIGS. 36, 37, 38 and 38A the locking sections have been modified as; examples of possible configurations. These illustrations are not intended to limit the possible designs of the locking sections, but rather to demonstrate examples of the possible modifications. In FIG. 36 the locking sections 752 and 754 of the clip 750 are designed in a modified S-shaped curve. In FIG. 37, the clip 770 is designed with locking section 772 and 774 having different configurations. The locking section 772 is formed in a L shape, with the leg 778 extending at approximately right angles from the body 776 and brace 772 running parallel to the body 776. The locking section 774 is a modified S, extending at approximately right angles to the body 776. In FIG. 38A, the locking sections 802 and 804 of the clip 800 extend at approximately right angles to the body 806, forming an approximate quarter circle.

Figure 39:
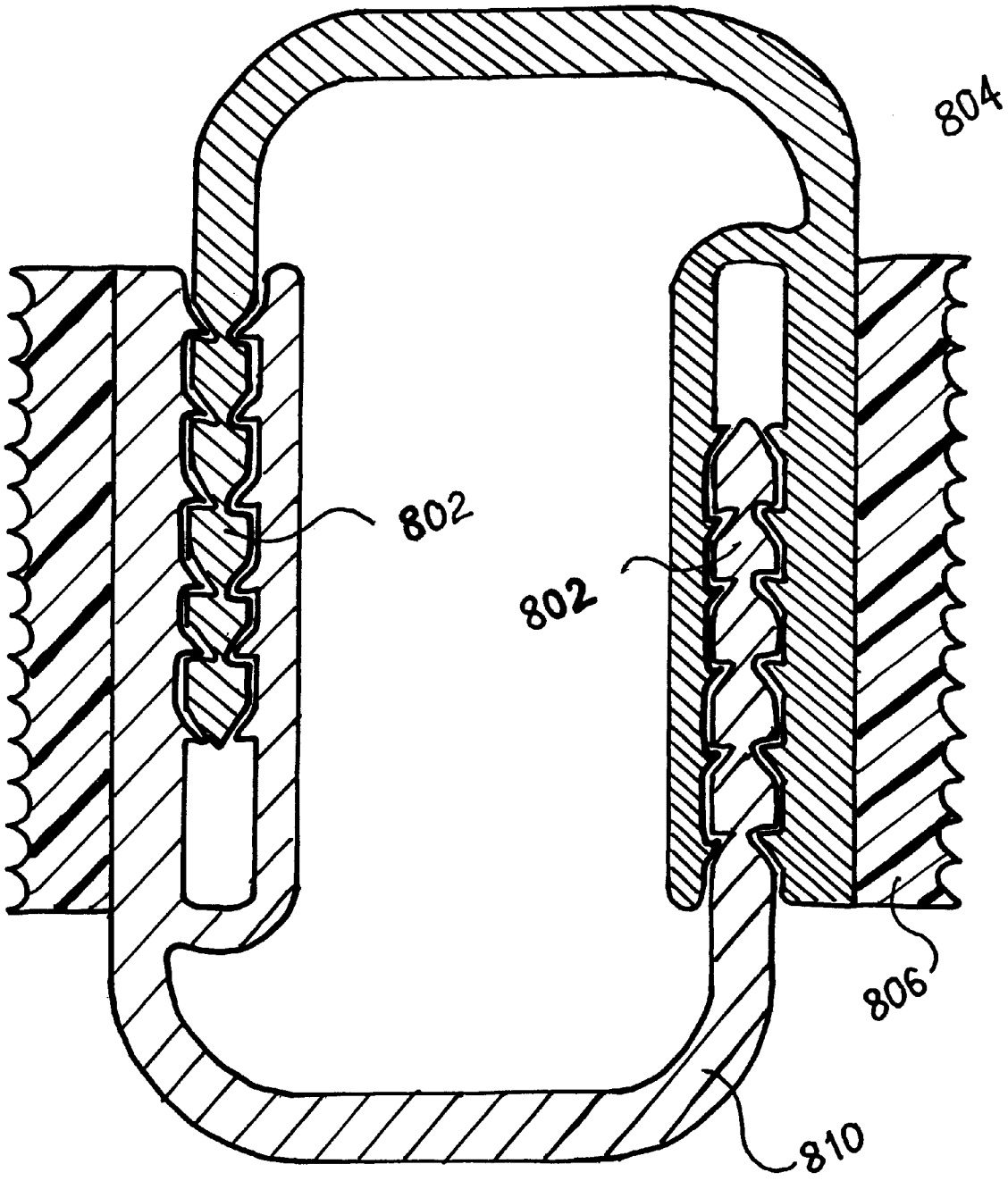
FIG. 39 is a side view of the clip of FIG. 38 assembled.

In FIGS. 38 and 39 an alternate to the foregoing clips is disclosed wherein a bi-clip unit 800 consists of two bi-clips 804 and 810. Each of the U-shaped bi-clips 804 and 810 contains a ridged male unit 802 and a complementary ridged female unit 808. A bumper 806 is affixed on the outside surface proximate the female unit 808. The unit 800 is interlocked as illustrated in FIG. 39, by inserting the male unit 802 of clip 810 into the female unit 808 of clip 804, thereby creating an oblong unit with bumpers 806 on opposite exterior sides. Although the configuration illustrated in FIG. 39 is a modified oblong with bumpers 806 on each side, the configuration can be altered according to end use. Modifications to the illustrated basic design can include a bumper on only one side, a more circular or rectangular unit, curved rather than angular ridges, as well as other modifications which will become apparent to those skilled in the art.

Figure 40:
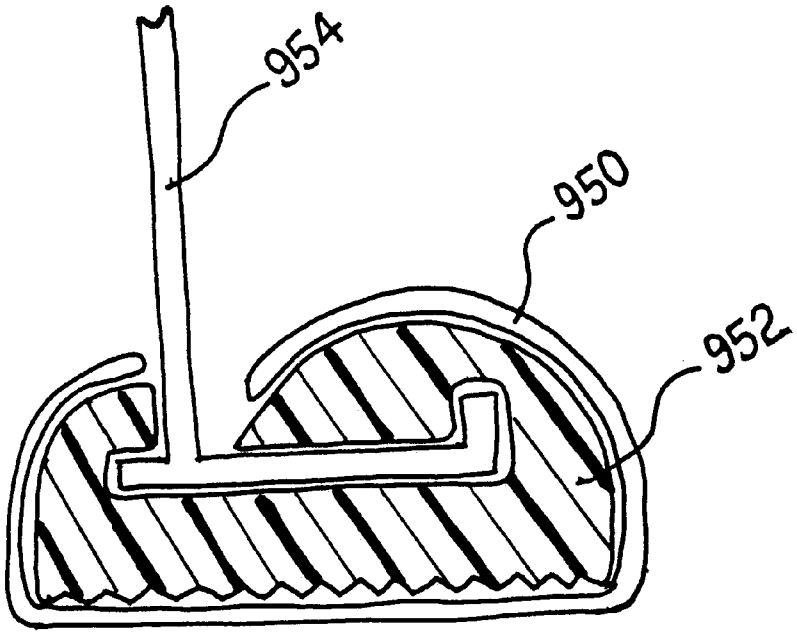
FIG. 40 is a side view of the exterior clip for securing a soft bumper.

In FIG. 40, a soft bumper 952 is provided which, although having the basic configuration of FIG. 2, is not as rigid. The soft bumper 952 has no structural support in of itself and requires bumper clip 950 to maintain the soft bumper 952 on the flange 954. The bumper clip 950 does not extend the length of the bumper 952 and serves as a retaining u:nit only. A bumper clip 950 would be placed approximately every 8–16 inches, depending upon the rigidity of the soft bumper 952.

Figure 41:
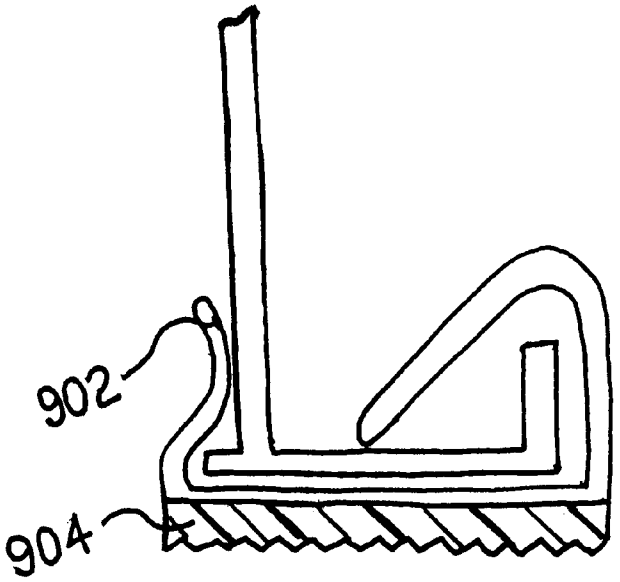
FIG. 41 is a side view of a stiff, flexible clip with a soft bumper attached.

In FIG. 41 a flexible clip 902 is manufactured with the bumper 904 adhered directly onto the base of the clip 902. The flexible clip 902 is manufactured in the approximate configuration of a ladder flange in order to allow the clip 902 to be used with most ladders. The plastic, or other material, used to manufacture the clip 902 must be resilient semi-rigid, or its equivalent, plastic which allows for the clip to be opened, without breakage, for placement or removal. The clip 902 must have sufficient memory and rigidity to return to its original configuration once it is released.

The foregoing bumper clips serve to affix a protective device onto a three dimensional object. The use of a protective bumper surface, attaching means and interlocking means provides a unique method of permanently, or temporarily, providing protection for an object. Although some embodiments disclosed are designed for particular use with ladders, the bumper clips can also be used with railings, pipes, stair treads, doors counter tops, small and large appliances, exercise equipment, tool handles, sporting equipment, fencing, office equipment, electronic equipment and power tools. The clips can further be used as weather stripping or a protective strip on various locations of lawn and garden, automotive, industrial and agricultural equipment.

The appended drawings show various modes of construction and installation of the load dispersing device for portable ladders which is the subject of the present invention, in order, together with this written description, to indicate to those skilled in the art how this invention achieves its objects of reducing damage and slipping in the use of any portable, non-free-standing ladder, while at the same time facilitating rather than restricting the adjustment of the ladder into the necessary operating position. Any and all combinations of such modes are intended to fall within the scope of this invention, as particularly set forth in the appended claims. Furthermore, the foregoing description of the invention has been directed to a particular preferred embodiment in accordance with the applicable statutes and for the purposes of explanation and illustration. It will be apparent to those skilled in the art that modifications and changes in the specifically described device may be made within the scope and true spirit of the invention in addition to alternative versions of the preferred embodiment described above. It is the applicants' intention in the following claims to cover such modifications and changes.

What is claimed is:

1. A load-dispersing device for use with a ladder having side rails, said side rails having a length and a load bearing area, and being separated by rungs, said rungs being in contact with said side rails, said load dispersing device comprising:

a pair of flexible load-dispersing members, said members having a first configuration and a second configuration and a memory to return said members from said second configuration to said first configuration, each of said pair of load-dispersing members having:

a contact area, said contact area having a width and a length, a locking area, said locking area having a width, a depth and a length, and being adjacent to at least a substantial portion of said contact area length, an interior cavity, said interior cavity being within said locking area depth, equal to said locking area length and having a predetermined periphery;

a longitudinal slit, said longitudinal slit being the length of said member and extending from said locking area's exterior surface into said interior cavity, whereby separating said longitudinal slit to expose said interior cavity places said member in said second configuration, enabling said member contact area to be mounted adjacent at least a portion of one of said load bearing area of said side rails and releasing said longitudinal slit returns said member to said first configuration, thereby securing said member around said side rails and maintaining said contact area adjacent said load bearing area.

2. The load dispersing device of claim 1 wherein said contact area and said locking area are integral with one another.

3. The load dispersing device of claim 2 wherein said contact area has an undulating surface.

4. The load dispersing device of claim 1 wherein said contact area and said locking area are separate from one another, said contact area length being affixed to said locking area length.

5. The load dispersing device of claim 4 wherein said contact area and said locking area are manufactured from materials having different densities.

6. The load dispersing device of claim 4 wherein said contact area has an undulating surface.

7. The load dispersing device of claim 4 wherein said locking area is a flexible, semi-rigid material having a memory.

8. The load dispersing device of claim 7 further comprising flanges, said flanges being integral with said contact area and adjacent at least a portion of said longitudinal slit, said flanges further adapted to secure said member to the ladder rails.

9. The load dispersing device of claim 1 wherein said load dispersing member is adapted to lie adjacent to said load bearing area when in said first configurations.

10. The load dispersing device of claim 1 wherein an outer periphery of said contact area and said locking area combined form a polygon.

11. The load dispersing device of claim 1 further comprising a spring, said spring being imbedded within said contact area to return said member to said first configuration.

12. The load dispersing device of claim 1 further comprising a pair of caps, each of said caps being at one end of the length of said member and being dimensioned to fit over an end of the side rails, said caps being an integral part of said members.

13. The load dispersing device of claim 1 further wherein said locking area further comprises cutouts, said cutouts being positioned along said locking area length to receive the ladder rungs.

14. The load dispersing device of claim 1 further comprising an exterior clip, said exterior clip having an interior configuration approximate the exterior configuration of said contact area and said locking area and having a length less than the length of said load-dispersing members, said exterior clip encompassing said member.

15. A method of preventing slippage of a ladder having a pair of spaced supports by using a load-dispersing device in combination with said ladder, said load-dispersing members having a first configuration, a second configuration and a memory to return said member from said second configuration to said first configuration, each of said pair of load-dispersing members having:

a contact area, said contact area having a width and a length, a contact area, said contact area having a width and a length, a locking area, said locking area having a width, a depth and a length, and being adjacent at least a substantial portion of said contact area length, an interior cavity, said interior cavity being within said locking area depth, equal to said locking area length and having a predetermined interior periphery;

a longitudinal slit, said longitudinal slit being the length of said member and extending from said locking area's exterior surface into said interior cavity, comprising the steps of:

a) flexing said contact area of a first of said pair of load-dispersing members, b) opening said longitudinal slit to expose said interior cavity, c) placing a portion of said interior cavity parallel to a contact surface adjacent a first of said spaced supports, d) releasing said load-dispersing member to allow said locking area to encompass said first spaced support, e) repeating a)–d), with a second of said pair of load-dispersing members and a second of said spaced supports, f) placing the ladder against a support structure to place said load-dispersing members in contact with the support structure, whereby climbing said ladder places pressure on said load-dispersing members, spreading said pressure along said load-dispersing members and preventing movement between said ladder and the support structure by creating increased friction between the support structure and said load-dispersing members.

* * * * *